US010894627B1

(12) United States Patent
Nicholson

(10) Patent No.: US 10,894,627 B1
(45) Date of Patent: Jan. 19, 2021

(54) PINCH-SEALED ADHESIVE SLEEVES

(71) Applicant: Amazon Technologies, Inc., Seattle, WA (US)

(72) Inventor: Chad R. Nicholson, Seattle, WA (US)

(73) Assignee: Amazon Technologies, Inc., Seattle, WA (US)

( * ) Notice: Subject to any disclaimer, the term of this patent is extended or adjusted under 35 U.S.C. 154(b) by 0 days.

(21) Appl. No.: 16/537,108

(22) Filed: Aug. 9, 2019

(51) Int. Cl.
*B65D 5/42* (2006.01)
*B65D 25/20* (2006.01)

(52) U.S. Cl.
CPC ..... *B65D 5/4245* (2013.01); *B65D 25/205* (2013.01); *B65D 2203/02* (2013.01); *B65D 2203/06* (2013.01); *B65D 2313/08* (2013.01)

(58) Field of Classification Search
CPC ..... B65D 5/4245; B65D 25/205; B65D 2313/08; B65D 2203/02; B65D 71/12; B65D 71/125; B65D 71/34
USPC ..... 40/306, 310, 312, 539, 637; 206/434; 229/87.05
See application file for complete search history.

(56) References Cited

U.S. PATENT DOCUMENTS 2,004,098 A 6/1935 Andrews
2,194,220 A 3/1940 Elder
2,251,402 A 8/1941 Drew
2,332,192 A 10/1943 Becker
3,039,245 A 6/1962 Jones
3,055,576 A 9/1962 Ottinger
3,098,583 A * 7/1963 Sherman ..... B65D 71/16 206/140
3,246,796 A * 4/1966 Euglander ..... B65D 71/28 206/192
3,498,449 A * 3/1970 Spery ..... B65D 71/16 206/148
3,650,383 A 3/1972 Nigro
3,656,683 A 4/1972 Desmond et al.
4,260,098 A 4/1981 Manizza et al.
4,494,689 A 1/1985 Ilitch
4,558,815 A 12/1985 Wischusen
(Continued)

OTHER PUBLICATIONS

Abhaya Asthana et al., "An Indoor Wireless System for Personalized Shopping Assistance", Proceedings of IEEE Workshop on Mobile Computing Systems and Applications, 1994, pp. 69-74, Publisher: IEEE Computer Society Press.
(Continued)

*Primary Examiner* — Joanne Silbermann
(74) *Attorney, Agent, or Firm* — Athorus, PLLC

(57) ABSTRACT

Adhesive sleeves are formed from blanks cut from sheets or rolls of paperboard, such as SBS or SBB paperboard, or any other materials. The adhesive sleeves include slack sections of one or more slack panels that provide additional length (e.g., slack) of circumferences or perimeters which enable the sleeves to be loosely wrapped or enveloped around a container of food products or one or more consumer goods. The slack sections may be shortened in length by joining the slack panels to one another, e.g., by an adhesive, to shorten the circumferences or perimeters and cause the adhesive sleeves to effectively clasp or surround the containers or goods therein. The adhesive sleeves may include any number of markings of any type or form on outer surfaces, including but not limited to instructions for use, nutrition facts, or images.

20 Claims, 19 Drawing Sheets

(56) References Cited

U.S. PATENT DOCUMENTS

| | | | |
|---|---|---|---|
| 5,255,841 | A | 10/1993 | Ritter |
| 5,307,982 | A | 5/1994 | Swindell |
| 5,645,300 | A | 7/1997 | Hill |
| 5,839,652 | A | 11/1998 | Ben-Haim |
| 7,225,980 | B2 | 6/2007 | Ku et al. |
| 7,870,995 | B1 | 1/2011 | Kaltman et al. |
| 7,949,568 | B2 | 5/2011 | Fano et al. |
| 8,009,864 | B2 | 8/2011 | Linaker et al. |
| 8,175,925 | B1 | 5/2012 | Rouaix |
| 8,189,855 | B2 | 5/2012 | Opalach et al. |
| 8,423,431 | B1 | 4/2013 | Rouaix et al. |
| 8,630,924 | B2 | 1/2014 | Groenevelt et al. |
| 8,688,598 | B1 | 4/2014 | Shakes et al. |
| 9,382,043 | B2 | 7/2016 | Rummo |
| 9,473,747 | B2 | 10/2016 | Kobres et al. |
| 9,505,516 | B2 | 11/2016 | Hubbard, Jr. et al. |
| 2002/0177513 | A1 | 11/2002 | Focke et al. |
| 2003/0002712 | A1 | 1/2003 | Steenburgh et al. |
| 2004/0181467 | A1 | 9/2004 | Raiyani et al. |
| 2005/0274780 | A1 | 12/2005 | Charlton |
| 2008/0055087 | A1 | 3/2008 | Horii et al. |
| 2008/0077511 | A1 | 3/2008 | Zimmerman |
| 2008/0109114 | A1 | 5/2008 | Orita et al. |
| 2009/0121017 | A1 | 5/2009 | Cato et al. |
| 2009/0245573 | A1 | 10/2009 | Saptharishi et al. |
| 2011/0011936 | A1 | 1/2011 | Morandi et al. |
| 2012/0284132 | A1 | 11/2012 | Kim et al. |
| 2013/0076898 | A1 | 3/2013 | Philippe et al. |
| 2013/0253700 | A1 | 9/2013 | Carson et al. |
| 2014/0263600 | A1 | 9/2014 | Valencia |
| 2014/0279294 | A1 | 9/2014 | Field-Darragh et al. |
| 2015/0016756 | A1 | 1/2015 | Down et al. |
| 2015/0019391 | A1 | 1/2015 | Kumar et al. |
| 2015/0073907 | A1 | 3/2015 | Purves et al. |

OTHER PUBLICATIONS

Cristian Pop, "Introduction to the BodyCom Technology", Microchip AN1391, May 2, 2011, pp. 1-24, vol. AN1391, No. DS01391A, Publisher: 2011 Microchip Technology Inc.

* cited by examiner

PINCH-SEALED ADHESIVE SLEEVES

BACKGROUND

Many retail establishments, such as grocery stores or convenience stores, offer prepared food products for purchase by consumers. For example, a retail establishment may prepare snacks, appetizers or portions of meals (e.g., courses such as a main course, a salad or a side dish) for sale to customers in kitchens, deli counters or at other facilities, and package the prepared foods in containers that maintain the prepared foods in a condition that enables the prepared foods to be eaten promptly, or after a brief period of preparation. Some food products that may be sold in this manner include sandwiches, noodles, soups, salads (such as garden salads, fruit salads or salads formed from mixtures of meats or vegetables with base products such as mayonnaise or mustard), meats (e.g., chicken, beef or ham), or many others. Some other food products that may be sold in this manner are meal kits, or sets of one or more courses or dishes of a meal, that may be consumed by customers from their containers, or from plates or dishes, with little to no additional preparation.

Prepared food products are increasingly popular among consumers who desire high-quality food products but are ill-suited to prepare them, or lack a sufficient amount of time to do so. The faster that food products may be prepared and placed in the hands of consumers, in a ready-to-eat condition, or in a nearly ready-to-eat condition, the better.

In order to maintain prepared foods in desirable conditions, prepared foods are typically packaged in appropriate containers and sealed. Such containers are generally formed from materials that are designed to readily receive food products therein, preserve the food products in their desired conditions, and be opened by an end user at or prior to a time at which the food products are to be served. Such containers are often formed from plastics such as polyethylenes of various densities or polystyrene (e.g., in solid or foamed forms), as well as metals (e.g., aluminum) or papers (e.g., cardboards of varying thicknesses), which may be opaque or have varying levels of transparency.

The materials from which a container of prepared foods is formed are selected for their ability or capacity to maintain the prepared foods at a desired temperature or pressure, or to resist leakage of water, oils or other substances, or portions of the food products, therefrom. Such containers frequently have one or more rounded surfaces that are not amenable to receiving labels or other markings (e.g., by pens or other ink markers) thereon. Even where a container includes one or more flat surfaces, however, such surfaces may be subjected to variations in temperature or moisture conditions that may render labels or markings applied thereon difficult to read or interpret.

Many prepared food products are required to bear information regarding their respective ingredients (e.g., nutrition facts), or include labels or other identifiers of the food products, such as where the food products may not be identified on sight. Additionally, many prepared food products, like most commercial goods, often bear price tags or other indicators of their respective costs. In some instances, prepared food products are wrapped with bands formed from paper or other like materials that may be marked with ink, graphite or other substances. However, such bands are often difficult to tightly wrap around a container. To date, applying paper bands to containers of prepared food products requires extended time and the use of glues, tapes or other substances, thereby increasing an amount of time that is required to prepare the food products and reducing an amount of time that is available to consumers for their enjoyment.

DETAILED DESCRIPTION

As is set forth in greater detail below, the present disclosure is directed to continuous, pre-formed sleeves having adhesive strips that fold onto the sleeves. The sleeves may be formed blanks of any suitable materials, such as papers, and having ends that are glued or otherwise joined to one another to form a continuous loop. Additionally, the blanks may be pre-scored with a number of scores or scored lines in locations where the blanks are to be folded to form adhesive sleeves therefrom.

Once formed from blanks, the sleeves may be wrapped around a container of prepared food products or other consumer goods, and portions of the sleeves may be folded onto one another, thereby reducing the internal dimensions of the sleeve. When portions of the sleeves are joined, e.g., by adhesive strips, internal dimensions of the sleeves are reduced, and the sleeves are effectively clasped to or around the containers in tension. The sleeves may be marked with relevant information regarding the food products on at least one side, including words, symbols, characters, images, bar codes (e.g., one-dimensional or two-dimensional bar codes encoded with information regarding the food products), or other markings. Adhesive sleeves may be formed from blanks at a location where the sleeves are expected to be applied to containers or, alternatively, at a different location prior to delivering the sleeves to the location where their use is anticipated.

Figure 1A:
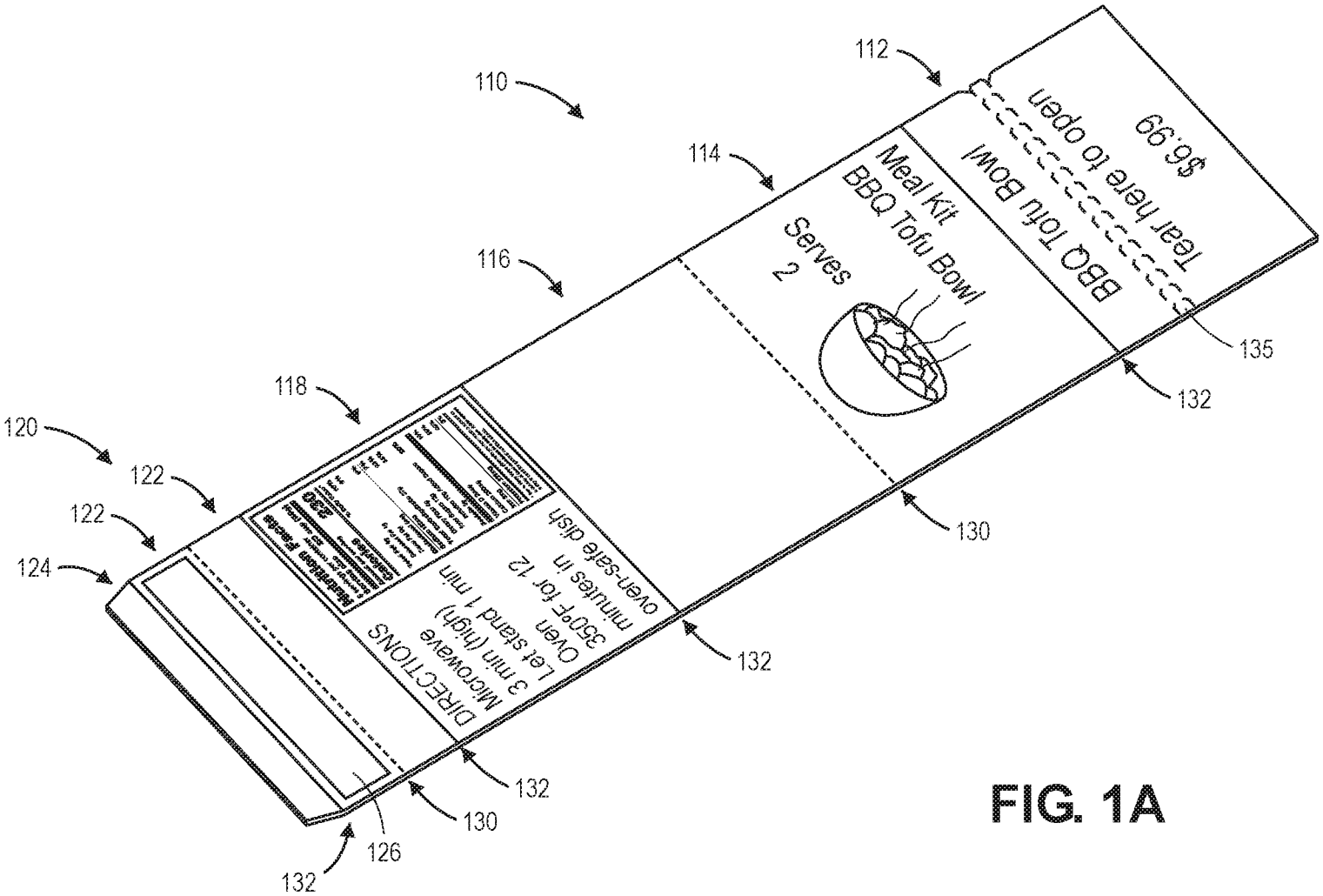
FIGS. 1A through 1G are views of one implementation of a sealable adhesive sleeve in accordance with the present disclosure.

Referring to FIGS. 1A through 1G, views of one implementation of a sealable adhesive sleeve in accordance with the present disclosure are shown. As is shown in FIG. 1A, a blank 110 includes a plurality of body panels 112, 114, 116, 118 and a slack section 120. The plurality of body panels 112, 114, 116, 118 include a top panel 112, a front panel 114, a bottom panel 116 and a back panel 118 that are arranged in series with the slack section 120.

The slack section 120 includes a pair of slack panels 122 and a tab panel (or end panel) 124. Additionally, as is shown in FIG. 1A, one of the slack panels 122 includes an adhesive 126 thereon. The adhesive 126 may include one or more layers of tape, such as a double-sided tape having one side bonded to one or both of the slack panels 122. In some implementations, the adhesive 126 may be a peel-and-seal tape or other like tape that includes one or more releasable liners releasably applied to another side of the adhesive 126, thereby temporarily preventing the other side of the adhesive 126 from bonding with one or more other surfaces. In some other implementations, the adhesive 126 may take any other form, including but not limited to liquids or gels (e.g., gel adhesives). Furthermore, in some implementations, each of the slack panels 122 may include adhesives 126 thereon.

Additionally, the blank 110 further includes scores, creases or folds joining the plurality of body panels 112, 114, 116, 118 and the slack section 120. For example, as is shown in FIG. 1A, the blank 110 is pre-scored with working scores 130 between corresponding edges of the slack panels 122, and between edges of the front panel 114 and the bottom panel 116. For example, the working scores 130 may include, but are not limited to, cuts, creases, grooves, perforations, ridges or any other features for aiding in folding of blanks or panels in specific locations, e.g., between corresponding edges of adjacent panels. In some implementations, the working scores 130 may be pre-scored cuts of approximately one-half of a thickness of the blank 110 (e.g., a cut of approximately a nine-point depth into an eighteen-point thick piece of paperboard or cardboard), thereby facilitating the folding of the blank 110 in such locations. In some implementations, cuts of one-quarter or other fractions of a thickness of the blank 110 may be made in between corresponding edges of adjacent panels, as necessary.

The blank 110 further includes a plurality of creases 132 between corresponding edges of the tab panel 124 and one of the slack panels 122, between corresponding edges of another of the slack panels 122 and the back panel 118, between corresponding edges of the back panel 118 and the bottom panel 116, and between corresponding edges of the front panel 114 and the top panel 112. Alternatively, in some implementations, the various panels of the blank 110, including but not limited to the slack section 120, may have working scores or creases at any of the corresponding edges of the various panels that are shown in FIG. 1A. In some implementations, the blank 110 need not include any working scores or creases. Furthermore, in the implementation shown in FIG. 1A, the top panel 112 further includes a strip 135 extending between free edges of the top panel 112. When an adhesive sleeve is formed into a continuous loop from the blank 110, and placed on a container or one or more commercial goods, the strip 135 may be ripped, torn or otherwise separated to open the continuous loop of the adhesive sleeve at the top panel 112.

As is also shown in FIG. 1A, the blank 110 includes a plurality of markings on a front face of the blank 110. The markings may include, but are not limited to, any number of letters, numbers, characters, symbols, images, or bar codes encoded with information, or other markings, relating to a food product or other consumer good with which an adhesive sleeve formed from the blank 110 is intended to be used. For example, in some implementations, the markings may include a name of a food product, nutrition facts regarding the food product (e.g., caloric content, serving sizes, percentages of daily recommended allowances of one or more ingredients or components of the food product), supplemental preparation instructions for the food product (e.g., times or temperatures at which the food product is to be cooked or cooled, as well as preferred temperatures), or images of the food product in use, either alone or with one or more other food products. Alternatively, in some implementations, the markings may include one or more advertisements for the food product, or for another food product, e.g., a food product that is a substitute for or a complement to the food product with which an adhesive sleeve formed from the blank 110 is intended to be used. Moreover, where an adhesive sleeve formed from the blank 110 is intended for use with a commercial good other than a food product, similar information regarding the commercial good may be shown or displayed by the one or more markings.

For example, as is shown in FIG. 1A, the top panel 112 includes a name of a food product, along with an operating instruction to access the food product. The front panel 114 includes a name and a category of the food product, as well as an image of the food product and a number of servings of the food product, while the bottom panel 116 is blank. The back panel 118 includes preferred and alternate preparation instructions for the food product, and nutrition facts for the food product. In some implementations, markings may be included on a rear face of the blank 110 (not shown). For example, markings or a rear face of the blank 110 may include instructions for assembling the blank 110 into an adhesive sleeve, or any other information.

Furthermore, markings may be applied to a front face of the blank 110, on one or more of the plurality of body panels 112, 114, 116, 118 intrinsically, e.g., with ink or other substances, at a time at which the blank 110 is formed. Alternatively, markings may be applied to one or more of the plurality of body panels 112, 114, 116, 118 extrinsically, e.g., by one or more decals, labels, stickers or other materials, either at the time that the blank 110 is formed, or at a later time, such as after the blank 110 has been formed into an adhesive sleeve, or after the adhesive sleeve has been applied around a container of one or more food products or other consumer goods.

The plurality of body panels 112, 114, 116, 118 and the slack section 120 of the blank 110 may be formed from any sufficiently durable materials, and may have any dimensions. For example, in some implementations, the plurality of body panels 112, 114, 116, 118 and the slack section 120 may be formed from a solid bleached board (or "SBB") or a solid bleached sulfate (or "SBS") paperboard of any density of thickness. Such paperboards may be formed from layers of bleached chemical pulp covered on either side by any number of coating layers. Moreover, in some implementations, the blank 110 may be white, or any other color. Alternatively, the blank 110 may be formed from any other materials, including but not limited to solid unbleached board, folding box board, or any other paperboard of any thickness, such as six-point, nine-point, twelve-point, eighteen-point or twenty-four point craft paperboard, or from any other cellulose-based or non-cellulose-based materials of any thickness. Moreover, the blank 110 may be made oil and grease resistant on one or both sides or faces, as necessary.

In some implementations, the plurality of body panels 112, 114, 116, 118 and the slack section 120 may have common widths and varying lengths, which may be selected to ensure that an adhesive sleeve formed from the blank 110 defines a cross-section having a desired height, width and/or area, such that the adhesive sleeve is sufficiently large to accommodate a selected container of the prepared foods therein.

The width of the blank 110 defines a depth of an adhesive sleeve defined therefrom. In some implementations, the blank 110 may have a width of approximately six-and-one-half inches (6.5"). Alternatively, the blank 110 may have any desired width.

Likewise, the length of the blank 110 defines a perimeter of an adhesive sleeve formed therefrom, subject to an overlap where the blank 110 is joined at its respective ends to form a continuous loop, e.g., the tab panel 124. In some implementations, the blank 110 may have a length of approximately twenty-five inches (25"). Alternatively, the blank 110 may have any desired length.

Furthermore, the placement of the working scores 130 and/or the creases 132 defines the lengths of the respective panels 112, 114, 116, 118. For example, as is shown in FIG. 1A, the lengths of the respective panels 112, 114, 116, 118 are approximately equal to one another. In some implementations, each of the panels 112, 114, 116, 118 may have a length of approximately five to six inches (5-6"), and a common width of approximately six-and-one-half inches (6.5"). Alternatively, in some implementations, the blank 110 may have any width and length, and may include working scores, creases or other demarcations that define any number of sides of an adhesive sleeve formed thereby.

Moreover, although the tab panel 124 is shown as having a tapered shape, such that a free edge of the tab panel 124 is shorter than an edge corresponding to the one of the slack panels 122 to which the tab panel 124 is joined, the tab panel 124 may have any shape with respect to the plurality of body panels 112, 114, 116, 118 or the slack section 120 in accordance with the present disclosure.

Figure 1B:
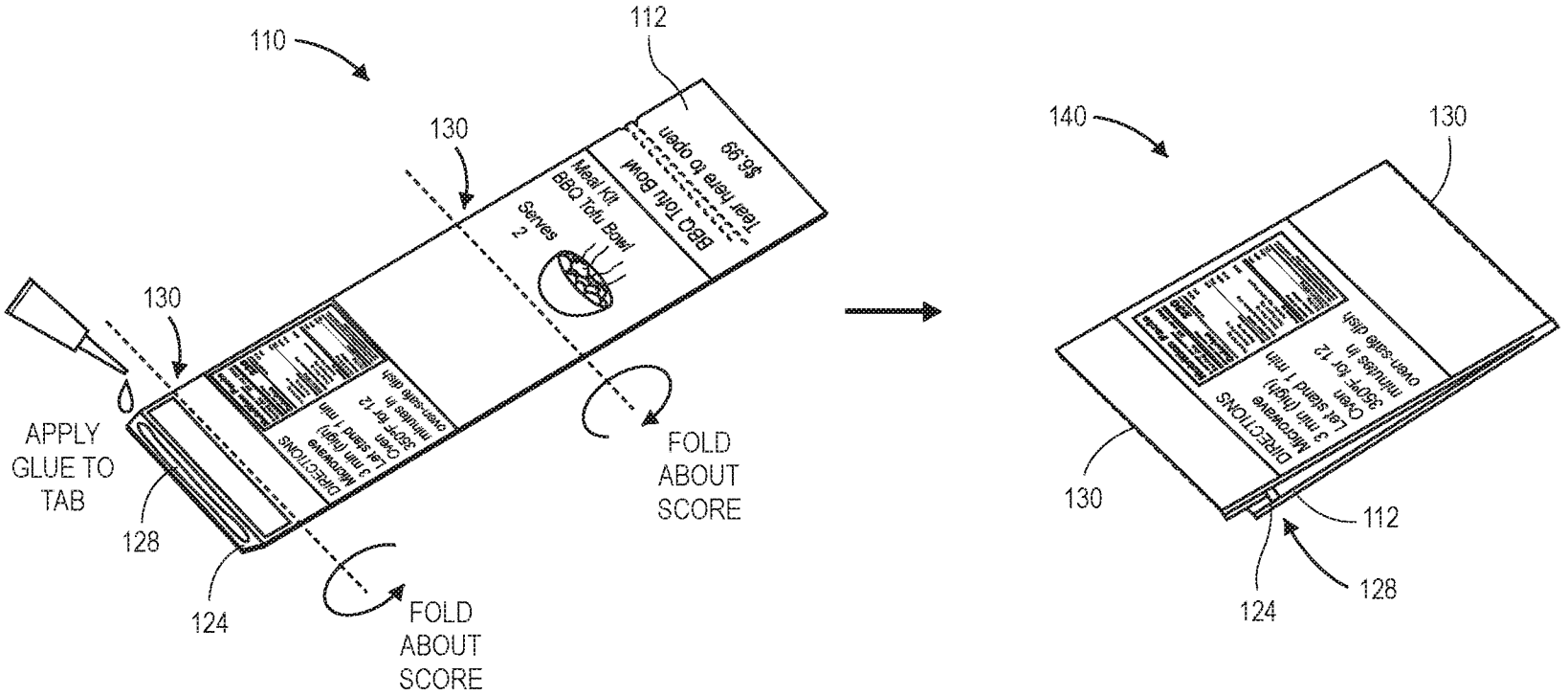

In accordance with implementations of the present disclosure, as is shown in FIG. 1B, an adhesive sleeve 140 may be formed by folding the blank 110 into a continuous loop and joining the blank 110 at its respective ends, e.g., the tab panel 124 and a free end of the top panel 112, by glue or other adhesives. As is shown in FIG. 1B, the blank 110 and the slack section 120 may be folded about the respective working scores 130 to join the tab panel 124 with the free end of the top panel 112.

For example, as is shown in FIG. 1B, a layer of glue 128 or another adhesive (e.g., tape) is applied to a top side of the tab panel 124, and the glue 128 is used to join the tab panel 124 to the top panel 112 at an underside of the top panel 112. Joining the tab panel 124 to the top panel 112, and folding the blank 110 about the working scores 130, results in the formation of the adhesive sleeve 140 in a flattened state or condition.

In some implementations, where adhesive sleeves are intended for use at a location where foods or other consumer goods are prepared, such as a market, a kitchen or another facility, blanks may be cut and/or printed from paperboard and transported to the location and assembled into adhesive sleeves there, e.g., by applying glue or another adhesive to an edge of a blank, and folding the blank about one or more working scores or creases, such as is shown in FIG. 1B. Alternatively, in some implementations, blanks may be cut, printed and assembled into adhesive sleeves in the flattened state or condition shown in FIG. 1B, and transported in the flattened state or condition to the location for use there.

Figure 1C:
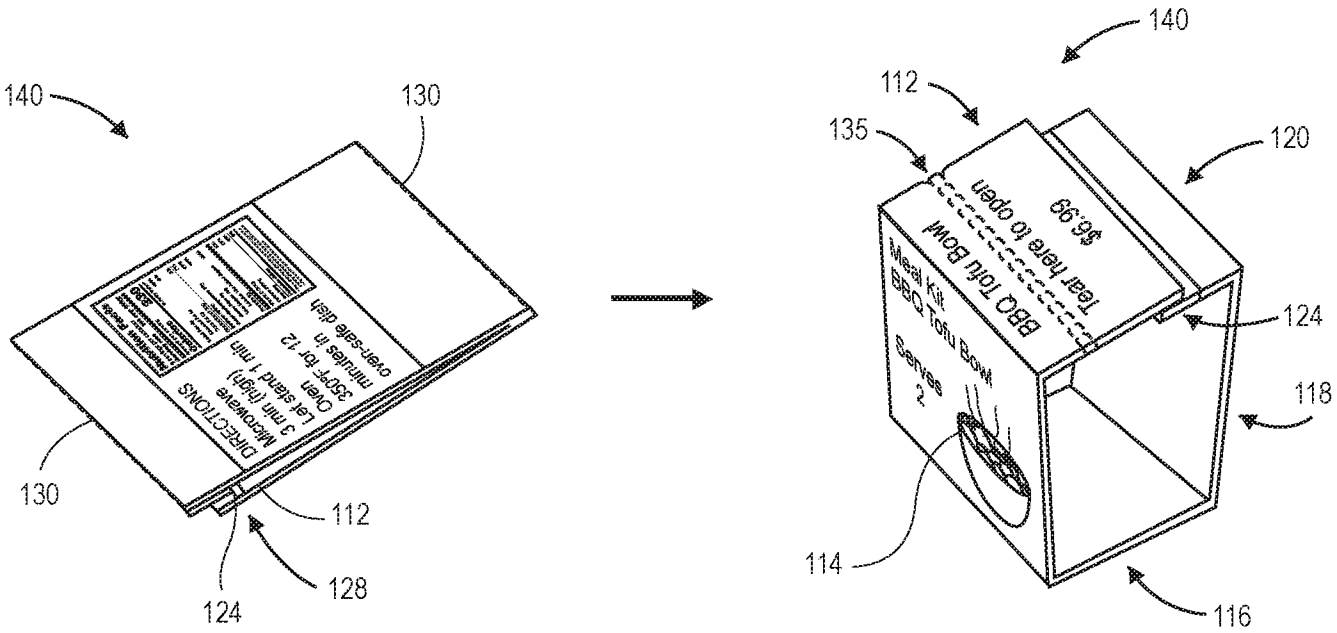
Figure 1D:
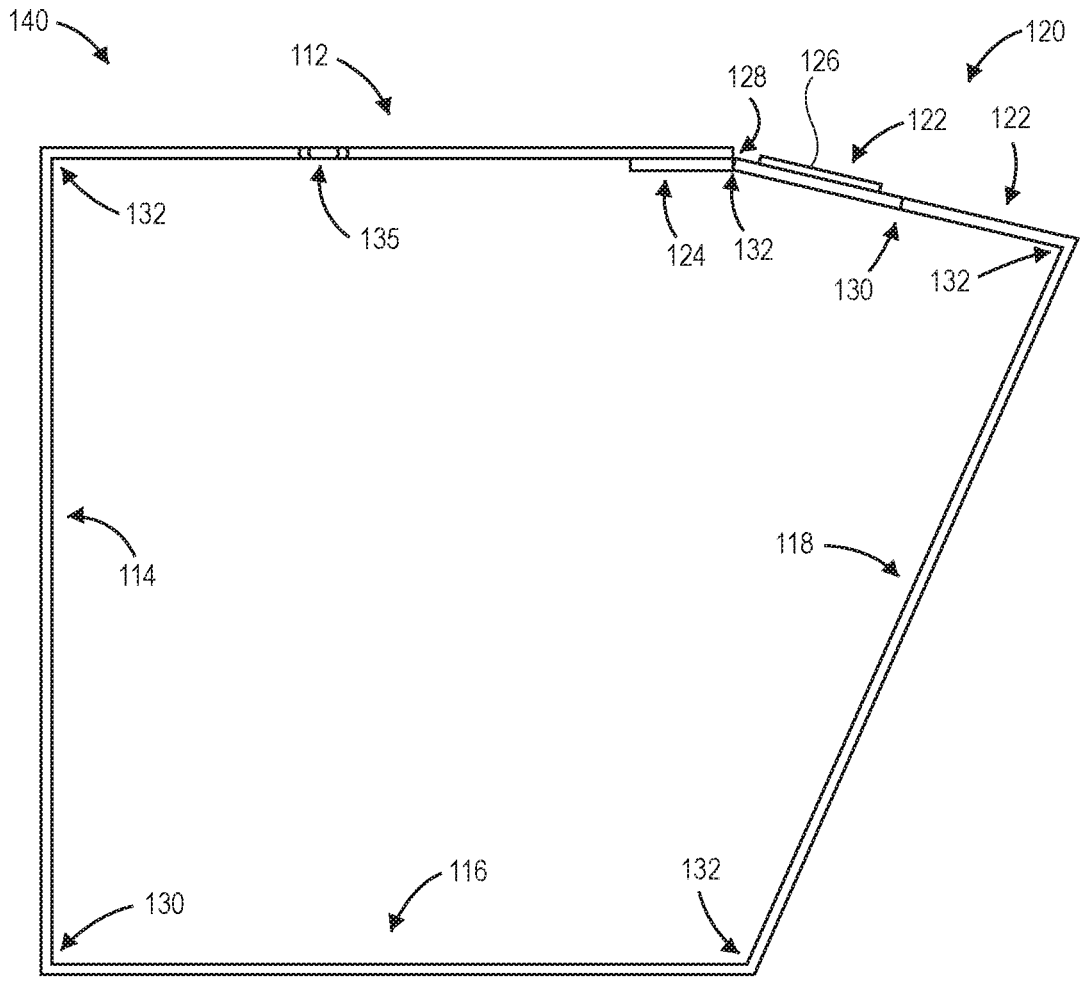

As is shown in FIG. 1C, when the adhesive sleeve 140, in the flattened state or condition shown in FIG. 1B, is intended for use in connection with a container of a prepared food product (e.g., a meal kit) or one or more consumer goods, the adhesive sleeve 140 may be opened into an expanded state or condition by folding the adhesive sleeve 140 about the crease 132 between corresponding edges of one of the slack panels 122 and the back panel 118, about the crease 132 between corresponding edges of the back panel 118 and the bottom panel 116, and about the crease 132 between corresponding edges of the front panel 114 and the top panel 112. In the expanded state or condition, the adhesive sleeve 140 has a substantially constant cross-section, as is shown in FIG. 1D. An upper portion of the adhesive sleeve 140 defined by the top panel 112 and the slack panels 122 is wider than a lower portion of the adhesive sleeve 140 defined by the bottom panel 116, due to the additional slack provided by the slack panels 122. Moreover, the left and right sides of the adhesive sleeve 140 defined by the front panel 114 and the back panel 118 have substantially equal lengths.

As is shown in FIG. 1D, the adhesive sleeve 140 is formed with five sides, including sides defined by the top panel 112, the front panel 114, the bottom panel 116, the rear panel 118 and the slack section 120. Alternatively, however, blanks of the present disclosure may include any number of panels, which may be folded at any angles with respect to one another, e.g., right angles (or perpendicularly), or at any angles other than right angles, and may be designed or configured to be formed into adhesive sleeves having any number of sides, or cross-sections or volumes of any other polygonal shapes (e.g., triangles, pentagons, hexagons, octagons or the like). Accordingly, the blanks of the present disclosure may take any corresponding shape or form, and may be formed from any number of panels of any relevant size or shape, or be configured to form adhesive sleeves of any size or shape.

Furthermore, in some implementations, blanks or adhesive sleeves formed therefrom may include windows or other openings that permit consumers to visibly evaluate contents of containers enclosed therein. Such windows or other openings may be of any size and take any shape or form, and may be cut or formed into any number of panels of a blank. Additionally, such panels may be optionally covered or sealed with one or more layers of transparent or translucent materials, such as cellophane or like materials, that may be applied to either side or face (or both sides or faces) of a blank, e.g., by glue or other adhesives, and may thus appear on internal or external surfaces of an adhesive sleeve formed from the blank.

Figure 1E:
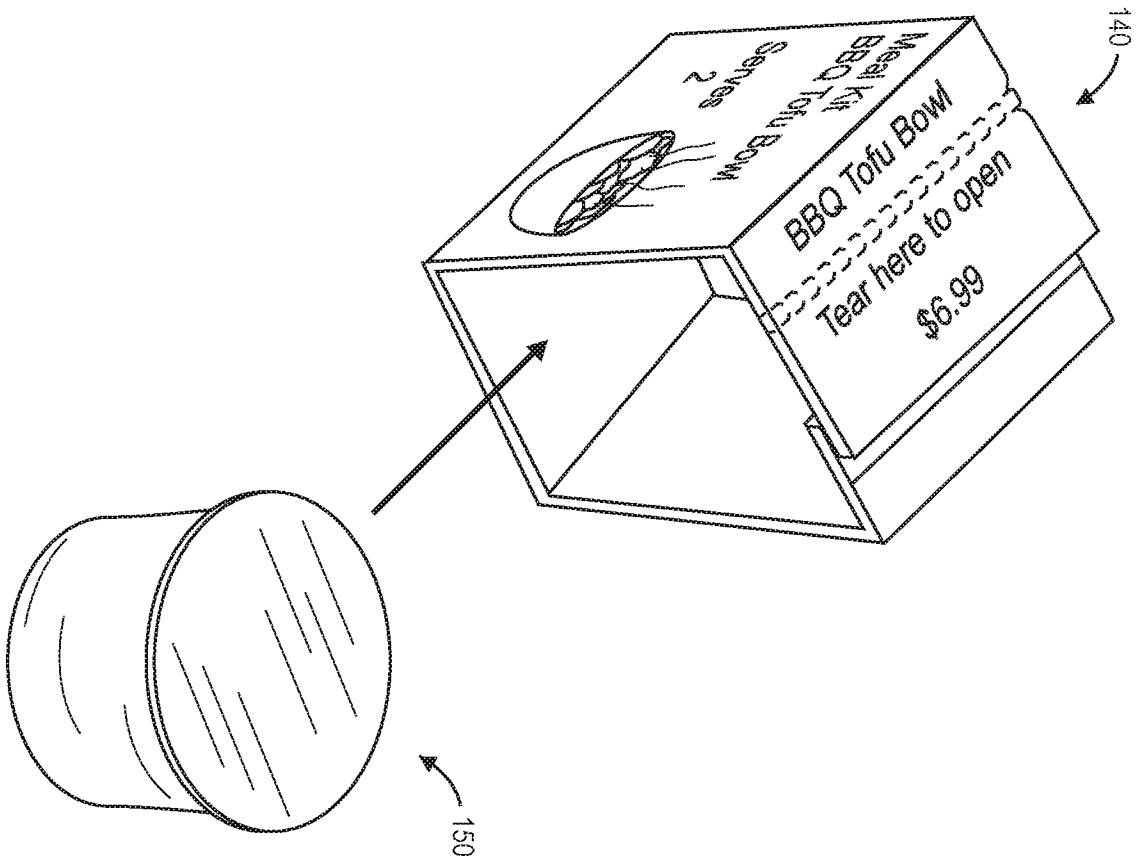

As is shown in FIG. 1E, once the adhesive sleeve 140 has been opened into the form shown in FIG. 1D, a container 150 including one or more prepared foods or other consumer goods may be inserted into the adhesive sleeve 140, e.g., along a longitudinal axis defined by the cross-section of the adhesive sleeve 140. In some embodiments, the plurality of body panels 112, 114, 116, 118 may have dimensions that are selected to surround or otherwise envelop a container of a selected size or shape, e.g., the container 150. For example, the bottom panel 116 may have one or more dimensions (e.g., a length or a width) that are selected to be greater than or equal to one or more dimensions (e.g., a diameter) of a bottom of the container 150. Likewise, the top panel 112 and/or the slack panels 122 may have dimensions that are selected to be greater than or equal to one or more dimensions (e.g., a diameter) of a top of the container 150. Furthermore, the front panel 114 and/or the back panel 118 may also have dimensions that are selected to be greater than or equal to one or more dimensions (e.g., a height) of the container 150. Additionally, when opened into the form shown in FIG. 1D, the various panels 112, 114, 116, 118 or the slack panels 122 of the adhesive sleeve 140 may be aligned at any angle with respect to one another, e.g., right angles (or perpendicularly), or at any angles other than right angles.

The container 150 may be formed from any suitable materials, including but not limited to polyethylenes, such as high density polyethylenes (or "HDPE") or low density polyethylenes (or "LDPE"), polystyrenes such as foam, metals such as aluminum, papers such as cardboard, or any other suitable materials. Furthermore, in some implementations, the container 150 may contain raw or cooked food products such as meats, poultry, seafood, vegetables, eggs, dairy products (e.g., milks or cheeses), soups, salads, desserts, or any other food products. Alternatively, in some implementations, the container 150 may be empty, e.g., where the container 150 itself is a commercial good that is available for purchase, or may include any other commercial goods not including food products, such as commercial goods that are slender in nature and may be effectively bundled. Moreover, in some implementations, such as where a consumer good has sufficient dimensions or shapes (e.g., where the consumer good is slender), one or more of the consumer goods may be gathered and inserted into the adhesive sleeve 140, and a container need not be utilized.

Figure 1F:
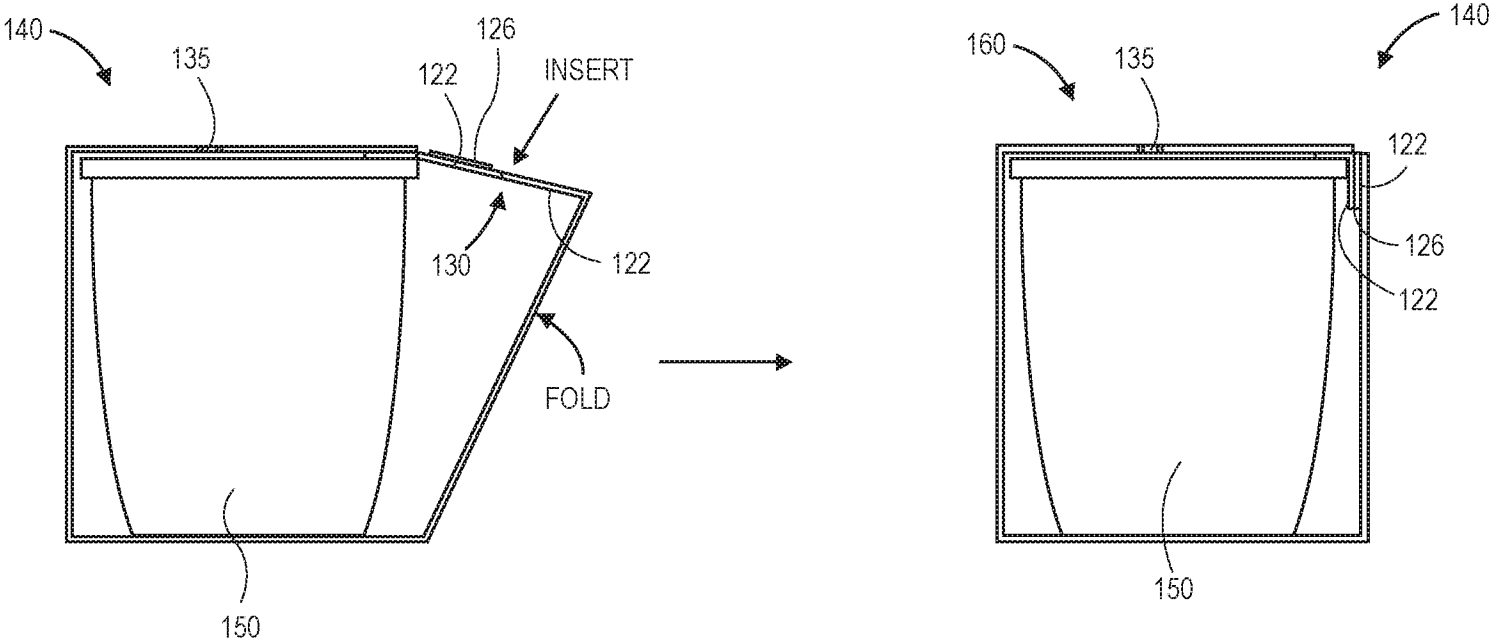

As is shown in FIG. 1F, with the container 150 inserted into the adhesive sleeve 140, a package 160 may be formed from the adhesive sleeve 140 and the container 150, e.g., by inserting the slack panels 122 into the cross-section of the adhesive sleeve 140 and folding one or more of the panels 112, 114, 116, 118 and the slack panels 122, as necessary, to reduce a size of the cross-section of the adhesive sleeve 140. For example, a force may be applied by a human hand or other instrument to cause the slack panels 122 to fold inwardly into the cross-section of the adhesive sleeve 140.

With the slack panels 122 folded into the cross-section, the back panel 118 is folded forward and toward the container 150, ensuring that the adhesive 126 on one of the slack panels 122 comes into contact with another of the slack panels 122, and joins the slack panels 122 adjacent to one another. In some implementations, a human may join the slack panels 122 to one another using fingers of a single hand, e.g., by pinching the edges of the slack panels 122 together. A layer may be removed from the adhesive 126 prior to applying force to the slack panels 122, thereby exposing an adhesive surface for causing the slack panels 122 to be joined together.

Figure 1G:
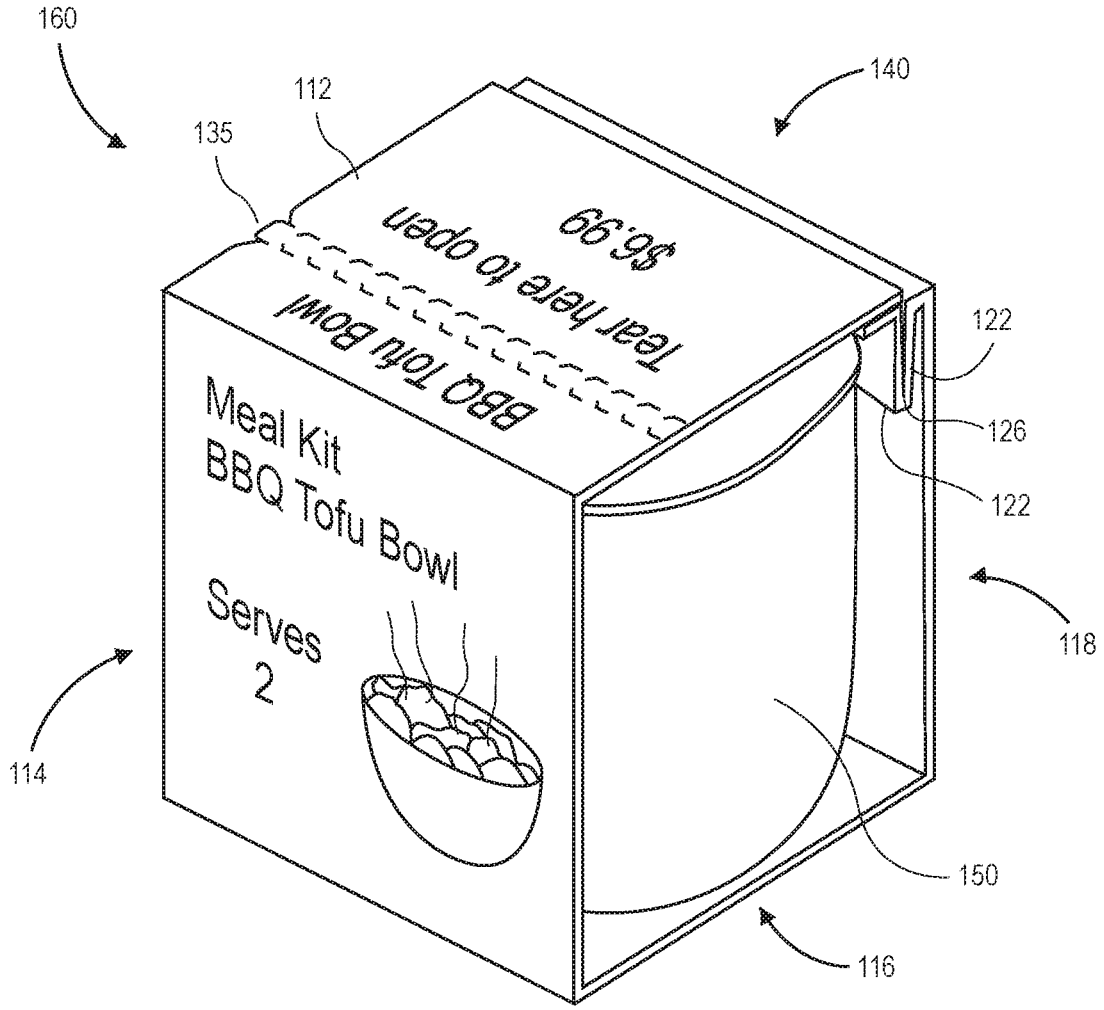

Accordingly, as is shown in FIG. 1G, the package 160 is formed by the adhesive sleeve 140, which is effectively clasped around the container 150 in tension with the slack panels 122 joined to one another, and with the container 150 resting on the bottom panel 116. In the configuration shown in FIG. 1G, the top panel 112 of the blank 110 is located on a top side of the package 160, while the front panel 114 of the blank 110 is located on a front side of the package 160, the bottom panel 116 is on an underside of the package 160, and the back panel 118 of the blank 110 is located on a back side of the package 160. Moreover, after the package 160 has the adhesive sleeve 140 has been clasped around the container 150 in tension, the various panels 112, 114, 116, 118 or the slack panels 122 of the adhesive sleeve 140 may be aligned at any angle with respect to one another, e.g., right angles (or perpendicularly), or at any angles other than right angles, and may form cross-sections of any shape. Furthermore, as is also shown in FIG. 1G, the markings on each of the top panel 112, the front panel 114 and the back panel 118 are readily visible to customers.

Additionally, after the package 160 is purchased by a customer, the customer may access the container 150 and the food products or other consumer goods contained therein by ripping, tearing or cutting the blank 110 in one or more locations. For example, a customer may access the container 150 by ripping, tearing or cutting the top panel 112 at the strip 135, e.g., using one or more fingers of a hand, from one free edge of the top panel 112 to another free edge of the top panel 112, which opens the adhesive sleeve 140 to expose the container 150.

Thus, adhesive sleeves of the present disclosure may be formed from blanks cut from rolls or sheets of paperboard (e.g., SBB or SBS paperboard) or other suitable materials. Various panels may be defined by lines within such blanks, with such lines being established with one or more scores, creases or other techniques, and the blanks may be folded along such lines to join opposite ends of such blanks and to form sleeves therefrom. Such panels may be sized or selected to correspond to front, rear, top, bottom or other sides on or around a container of food products or other consumer goods. The blanks may further include slack sections of one or more slack panels that provide extra length (or slack) to circumferences or perimeters of adhesive sleeves formed from such blanks. The additional slack of the adhesive sleeves enables such sleeves to be readily wrapped around containers of food products, or one or more consumer goods. When an adhesive sleeve is wrapped around a container or one or more consumer goods, a package may be defined by effectively clasping the adhesive sleeve around the container or the consumer goods in tension, e.g., by collapsing the slack sections and joining two or more of the slack panels together, which reduces the length of the circumferences or perimeters. Subsequently, when the container or the consumer goods are desired for consumption, a consumer may rip, tear, cut or otherwise open the adhesive sleeve and access the container or the consumer goods.

Panels of such blanks may be defined or separated by lines provided on one or more sides or faces of such blanks, with such lines being defined by one or more impressions, creases or other modifications imposed on either side or face of the blanks for the purpose of positioning and/or facilitating folds within the blanks. Some scores may include, but are not limited to, creases, grooves, perforations, ridges or any other features for aiding in folding of blanks.

Those of ordinary skill in the pertinent arts will recognize that the adhesive sleeves of the present disclosure may include any type of markings thereon, including but not limited to text, numbers, characters, symbols, images or bar codes. Moreover, such markings may be expressed in both visible and tactile forms. For example, the identifiers may be presented in variations of color that may be viewed by a consumer, or with one or more raised, indented or embossed features that may be sensed by the consumer.

As is discussed above, the adhesive sleeves of the present disclosure may be formed from blanks that are cut from any type or form of material, such as SBB or SBS paperboard. Ends of the blanks may be joined by glue or other adhesives to form the adhesive sleeves. Referring to FIGS. 2A through 2I, views of one implementation of a sealable adhesive sleeve in accordance with the present disclosure are shown. Except where otherwise noted, reference numerals preceded by the number "2" shown in FIGS. 2A through 2I indicate components or features that are similar to components or features having reference numerals preceded by the number "1" shown in FIGS. 1A through 1G.

Figure 2A:
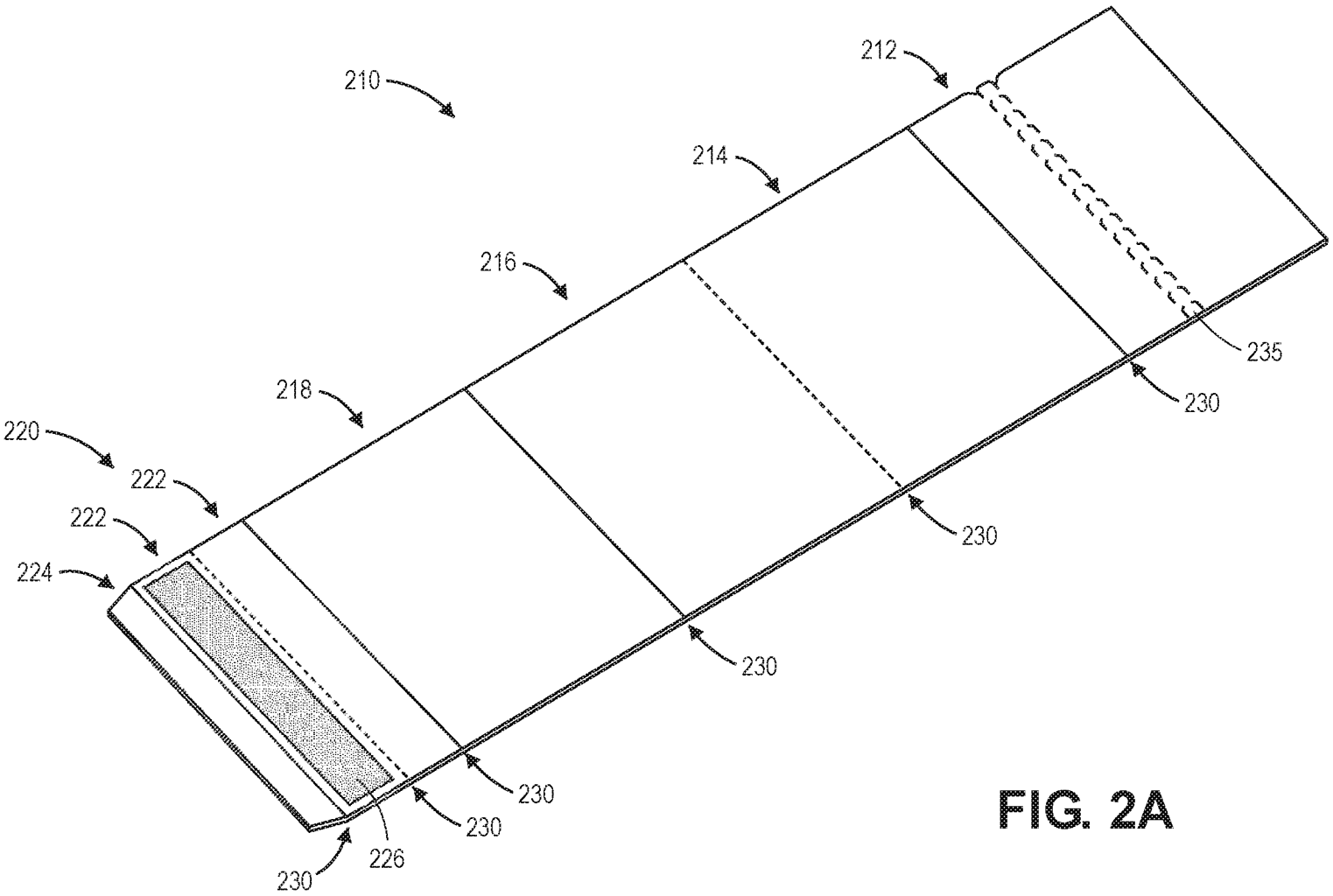
FIGS. 2A through 2I are views of one implementation of a sealable adhesive sleeve in accordance with the present disclosure.
Figure 2B:
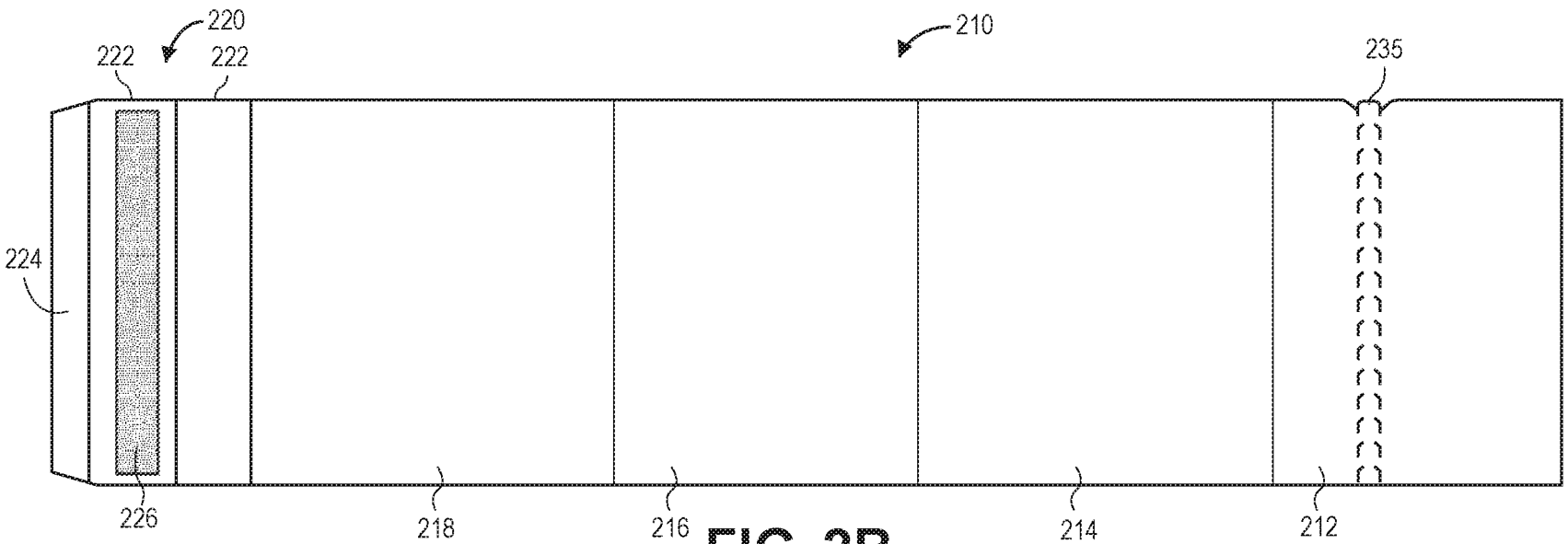
Figure 2C:
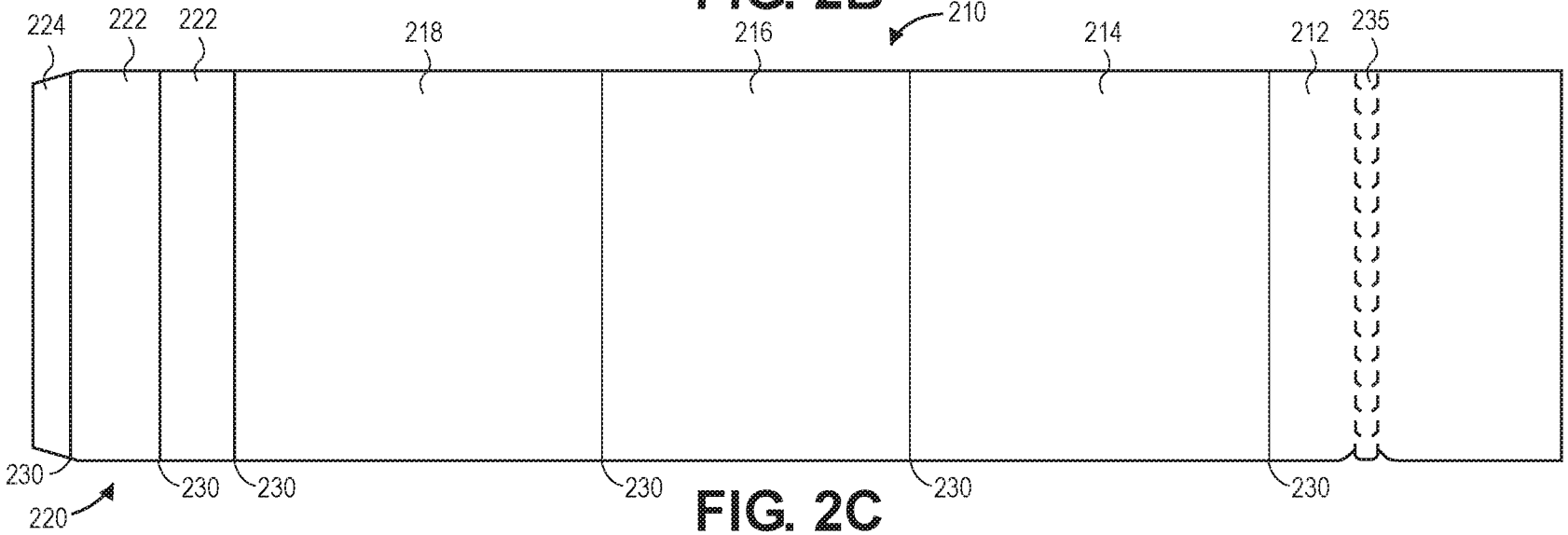
Figure 2D:
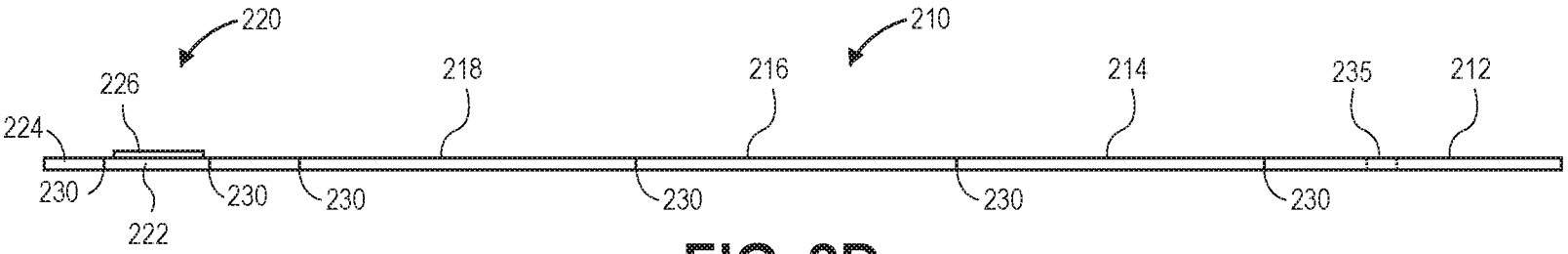
Figure 2E:
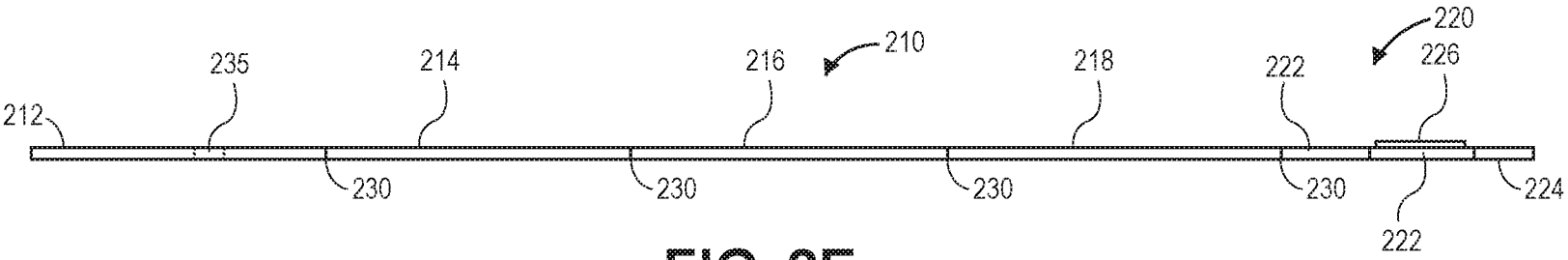
Figure 2G:
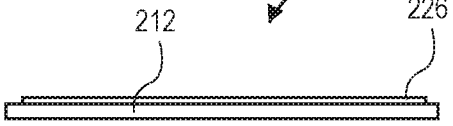
Figure 2F:
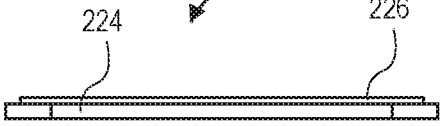

FIG. 2A is a perspective view of a blank 210 from which an adhesive sleeve may be formed. FIG. 2B is a front view of the blank 210, and FIG. 2C is a rear view of the blank 210. FIG. 2D is a top view of the blank 210, and FIG. 2E is a bottom view of the blank 210. FIG. 2F is a left view of the blank 210, and FIG. 2G is a right view of the blank 210. FIG. 2H is a perspective view of an adhesive sleeve 240 formed from the blank 210, and FIG. 2I is a side view of the adhesive sleeve 240.

As is shown in FIGS. 2A through 2I, the blank 210 includes a plurality of body panels 212, 214, 216, 218, a slack section 220 and a tab panel 224 that are arranged in series. The plurality of body panels 212, 214, 216, 218 include a top panel 212, a front panel 214, a bottom panel 216 and a rear panel 218. The slack section 220 includes a pair of slack panels 222. A tab panel 224 is joined to one of the slack panels 222. An adhesive layer 226 is applied to a front face of one of the slack panels 222. The top panel 212 includes a strip 235 that may be ripped, torn or otherwise separated to open a continuous loop of an adhesive sleeve formed from the blank 210 at the top panel 212.

As is also shown in FIGS. 2A through 2G, the blank 210 includes a plurality of lines 230 (or boundaries) between corresponding edges of adjacent panels. The lines 230 may include or be defined by working scores, creases, grooves, perforations, ridges or other folding aids that enable the blank 210 to be readily folded along such lines 230.

Figure 2I:
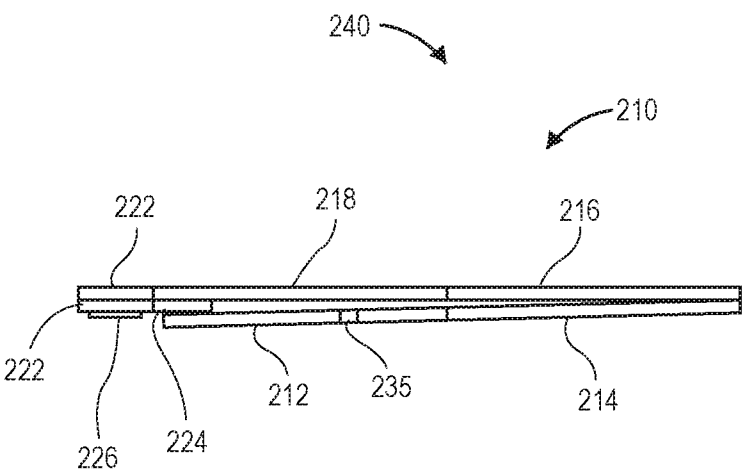
Figure 2H:
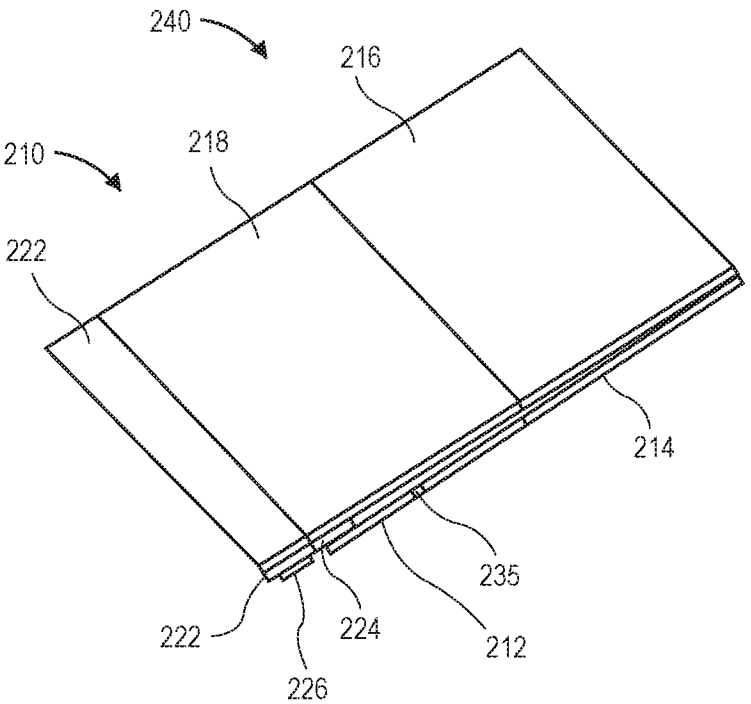

As is further shown in FIGS. 2H and 2I, the adhesive sleeve 240 may be formed from the blank 210 of FIGS. 2A through 2I by joining the tab panel 224 to a free edge of the top panel 212, and folding the corresponding edges of the top panel 212, the front panel 214, the bottom panel 216, the back panel 218 and the slack panels 222 about the lines 230. The adhesive sleeve 240 may be opened, such as is shown in FIG. 1C, and wrapped around a container or one or more consumer goods, such as is shown in FIG. 1E. The adhesive sleeve 240 may be clasped around the container or the consumer goods in tension by folding the slack panels 222 toward one another, e.g., by pinching the edges of the slack panels 222 together, and causing the slack panels 222 to be joined by the adhesive 226, such as is shown in FIG. 1F.

Additionally, in accordance with implementations of the present disclosure, slack sections may be provided between any pair of panels in a blank from which an adhesive sleeve may be formed. Referring to FIGS. 3A through 3I, views of one implementation of a sealable adhesive sleeve in accordance with the present disclosure are shown. Except where otherwise noted, reference numerals preceded by the number "3" shown in FIGS. 3A through 3I indicate components or features that are similar to components or features having reference numerals preceded by the number "2" shown in FIGS. 2A through 2I or by the number "1" shown in FIGS. 1A through 1G.

Figure 3A:
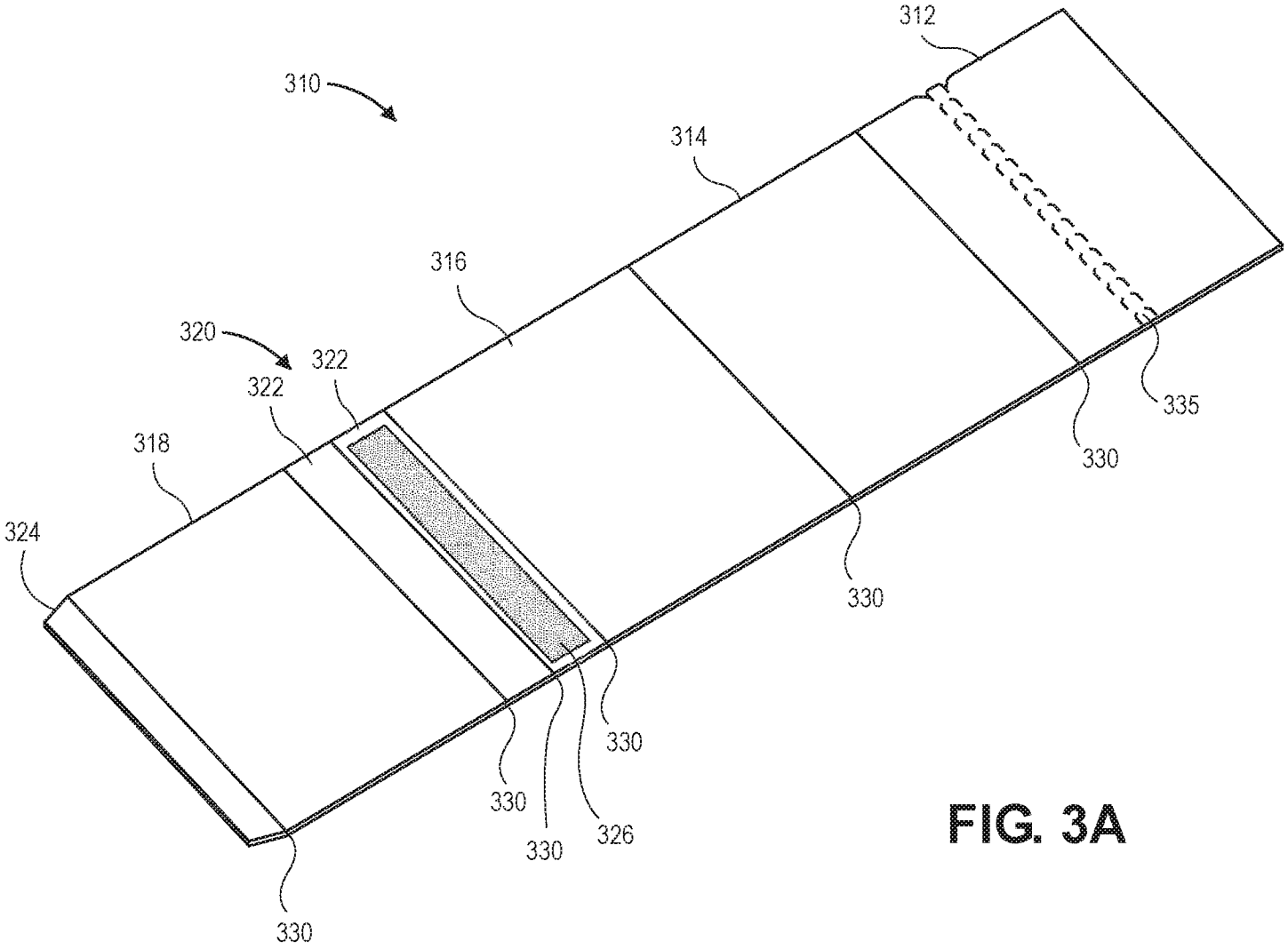
FIGS. 3A through 3I are views of one implementation of a sealable adhesive sleeve in accordance with the present disclosure.
Figure 3B:
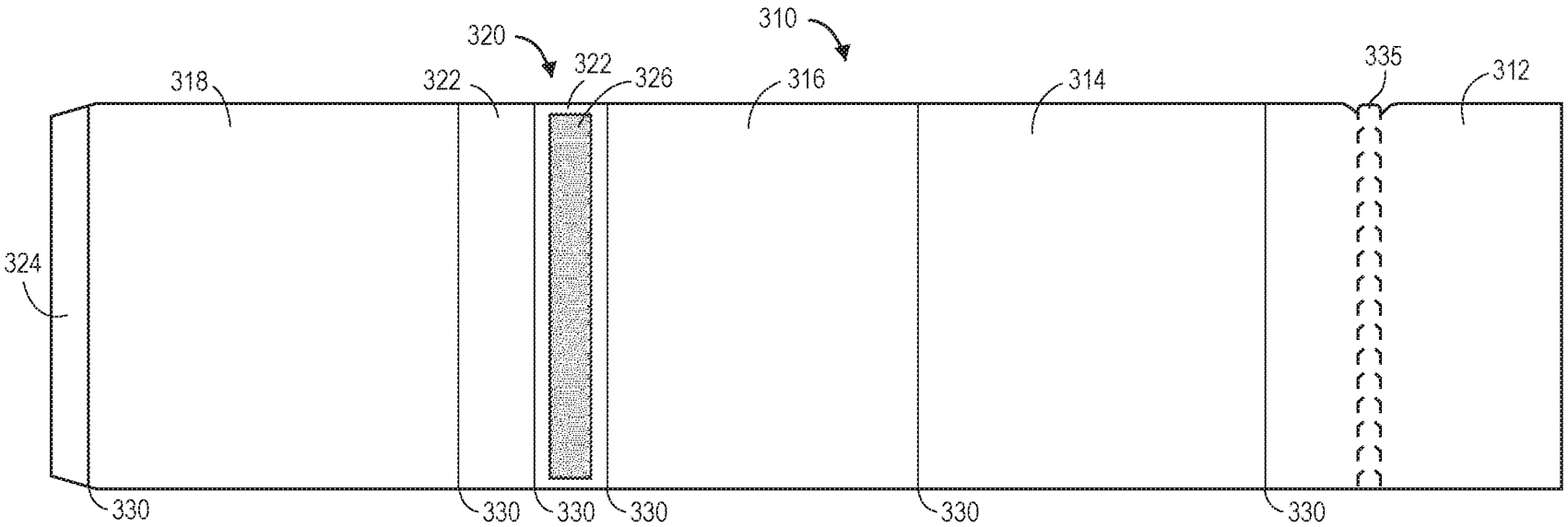
Figure 3C:
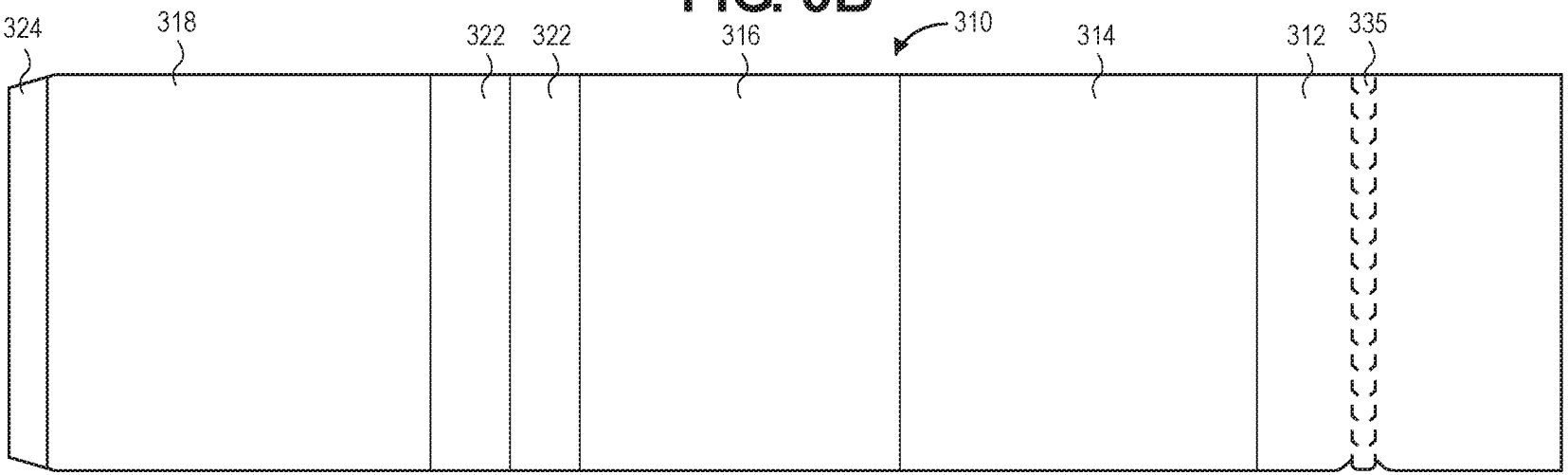
Figure 3D:
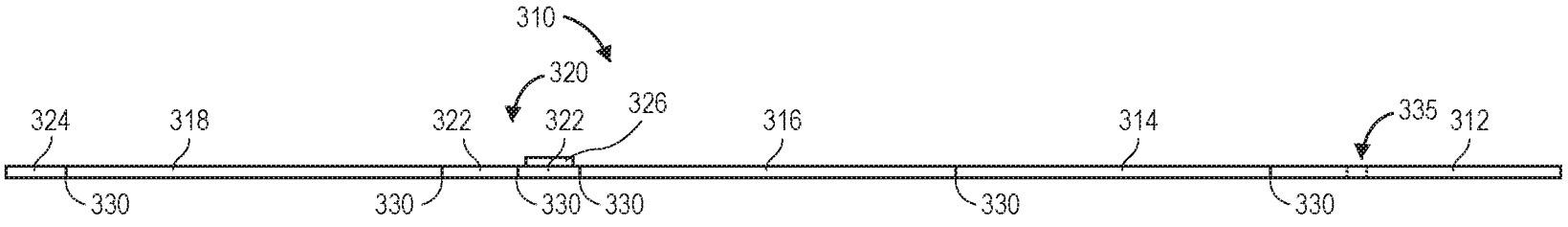
Figure 3E:
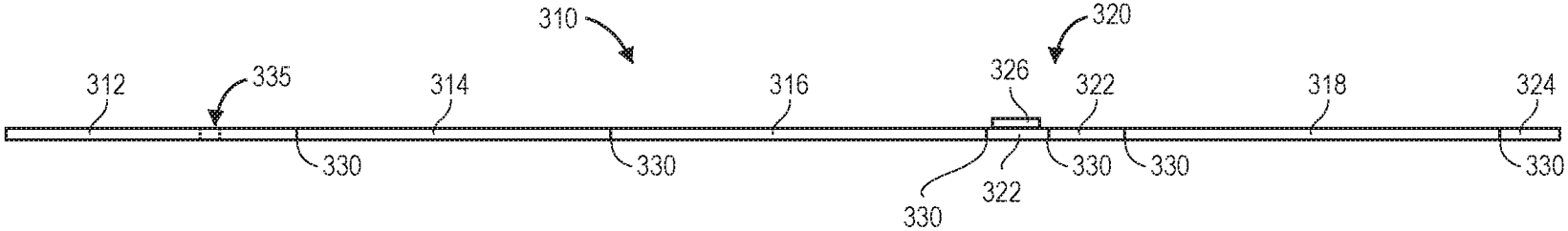
Figure 3G:
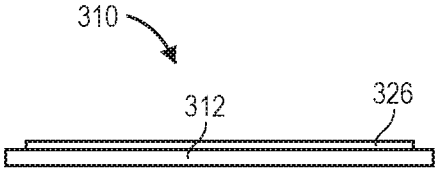
Figure 3F:
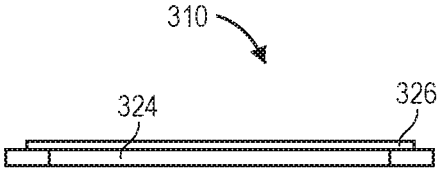

FIG. 3A is a perspective view of a blank 310 from which an adhesive sleeve may be formed. FIG. 3B is a front view of the blank 310, and FIG. 3C is a rear view of the blank 310. FIG. 3D is a top view of the blank 310, and FIG. 3E is a bottom view of the blank 310. FIG. 3F is a left view of the blank 310, and FIG. 3G is a right view of the blank 310. FIG. 3H is a perspective view of an adhesive sleeve 340 formed from the blank 310, and FIG. 3I is a side view of the adhesive sleeve 340.

The blank 310 shown in FIGS. 3A through 3I includes many of the qualities or features of the blank 210 shown in FIGS. 2A through 2I. As is shown in FIGS. 3A through 3I, the blank 310 includes a plurality of body panels 312, 314, 316, 318, a slack section 320 and a tab panel 324 that are arranged in series. The plurality of body panels 312, 314, 316, 318 includes a top panel 312, a front panel 314, a bottom panel 316 and a rear panel 318. The slack section 320 includes a pair of slack panels 322. Unlike the blank 210 of FIGS. 2A through 2G, however, the slack section 320 is provided between the bottom panel 316 and the back panel 318. The tab panel 324 is joined to a corresponding edge of the back panel 318. An adhesive layer 326 is applied to a front face of one of the slack panels 322. The top panel 312 includes a strip 335 that may be that may be ripped, torn or otherwise separated to open a continuous loop of an adhesive sleeve formed from the blank 310 at the top panel 312.

As is also shown in FIGS. 3A through 3G, the blank 310 includes a plurality of lines 330 (or boundaries) between corresponding edges of adjacent panels. The lines 330 may include or be defined by working scores, creases, grooves, perforations, ridges or other folding aids that enable the blank 310 to be readily folded along such lines 330.

Figure 3I:
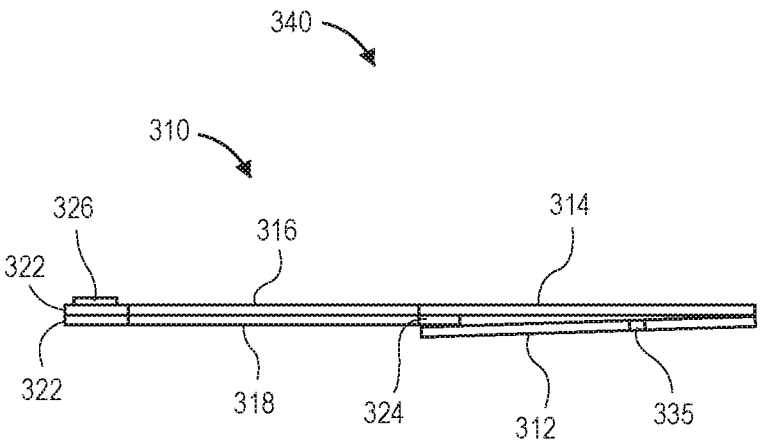
Figure 3H:
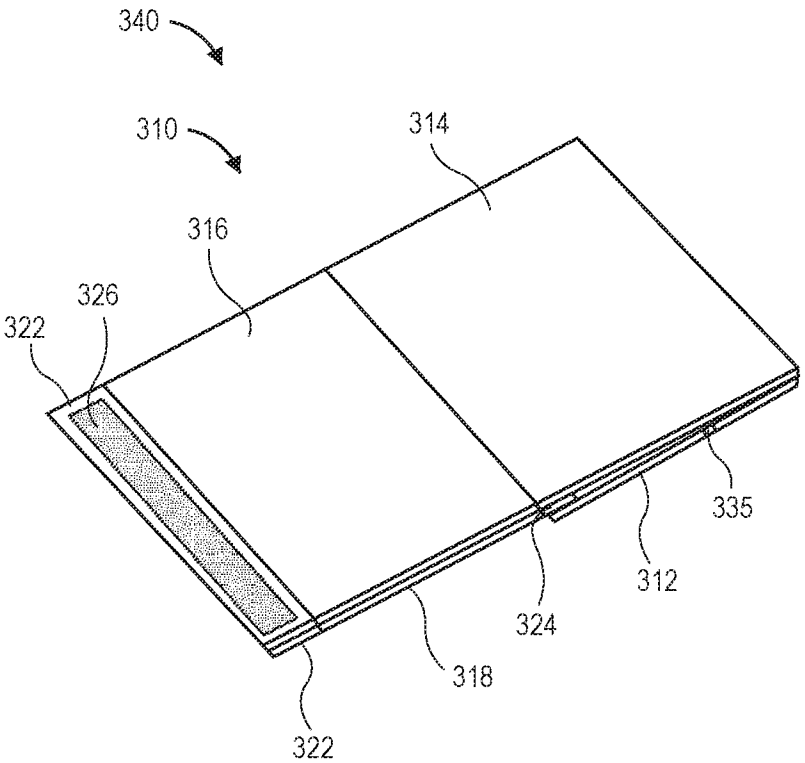

As is further shown in FIGS. 3H and 3I, the adhesive sleeve 340 may be formed from the blank 310 of FIGS. 3A through 3I by joining the tab panel 324 to a free edge of the top panel 312, and folding the corresponding edges of the top panel 312, the front panel 314, the bottom panel 316, the back panel 318 and the slack panels 322 about the lines 330. The adhesive sleeve 340 may be opened, such as is shown in FIG. 1C, and wrapped around a container or one or more consumer goods, such as is shown in FIG. 1E. The adhesive sleeve 340 may be clasped around the container or the consumer goods in tension by folding the slack panels 322 toward one another, e.g., by pinching the edges of the slack panels 322 together, and causing the slack panels 322 to be joined by the adhesive 326, such as is shown in FIG. 1F.

As is discussed above, the adhesive sleeves of the present disclosure may be used to wrap or combine one or more consumer goods, e.g., in a bundled manner, and are not limited for use in connection with containers or food products. Referring to FIGS. 4A through 4D, views of one implementation of a sealable adhesive sleeve in accordance with the present disclosure are shown. Except where otherwise noted, reference numerals preceded by the number "4" shown in FIGS. 4A through 4D indicate components or features that are similar to components or features having reference numerals preceded by the number "3" shown in FIGS. 3A through 3I, by the number "2" shown in FIGS. 2A through 2I or by the number "1" shown in FIGS. 1A through 1G.

Figure 4A:
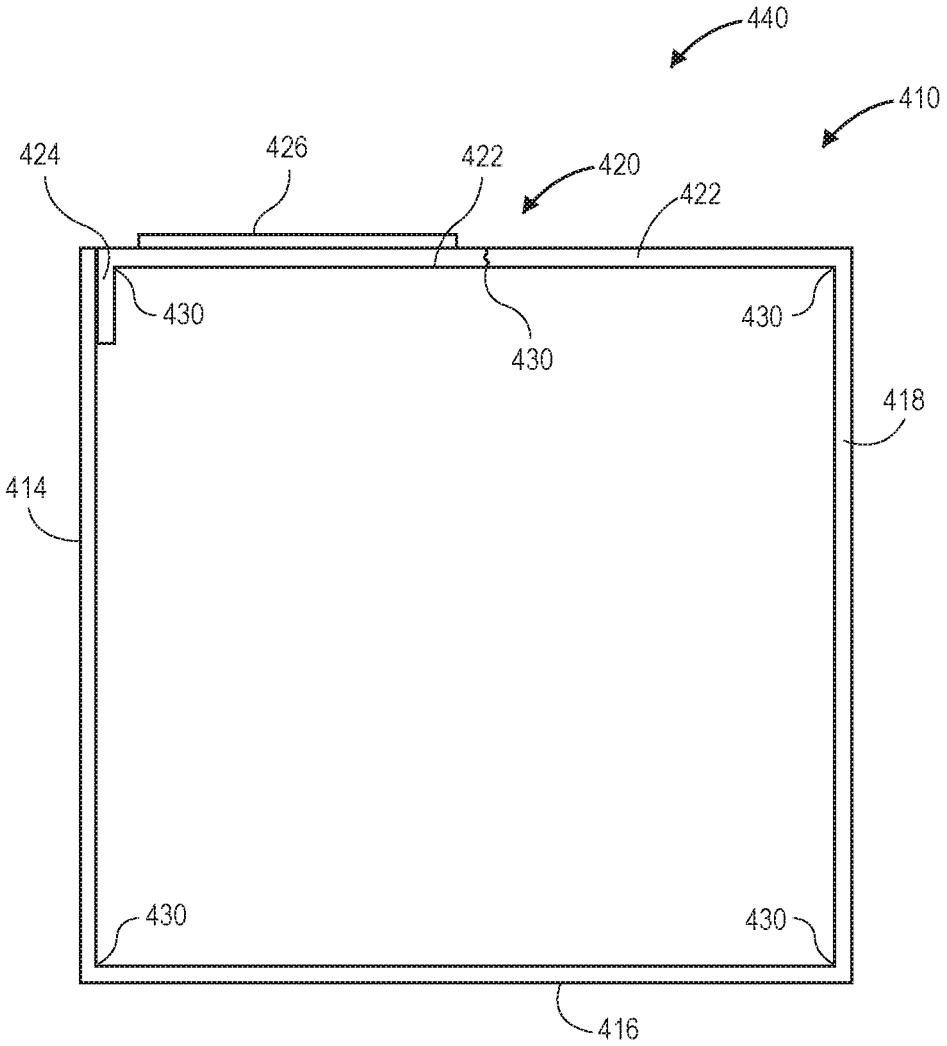
FIGS. 4A through 4D are views of one implementation of a sealable adhesive sleeve in accordance with the present disclosure.

As is shown in FIG. 4A, an adhesive sleeve 440 is formed from a blank 410 having a plurality of body panels 414, 416, 418, a slack section 420 and a tab panel 424 that are arranged in series. The plurality of body panels 414, 416, 418 includes a front panel 414, a bottom panel 416 and a back panel 418. The slack section 420 includes a pair of slack panels 422. The adhesive sleeve 440 has a substantially rectangular cross-section and is defined by joining the tab panel 424 to an underside of the front panel 414. The various panels 414, 416, 418 or the slack panels 422 of the adhesive sleeve 440 may be aligned at any angle with respect to one another, e.g., right angles (or perpendicularly), or at any angles other than right angles, and may form cross-sections of any shape. The slack panels 422 are separated by a line 430, which may be defined by one or more working scores, creases, grooves, perforations, ridges or other folding aids. Likewise, each of the corners of the adhesive sleeve 440 is further defined by a line 430, e.g., between corresponding edges of the front panel 414 and the bottom panel 416, the bottom panel 416 and the back panel 418, or between the back panel 418 and one of the slack panels 422. Additionally, one of the slack panels 422 includes an adhesive 426 applied thereon.

Figure 4B:
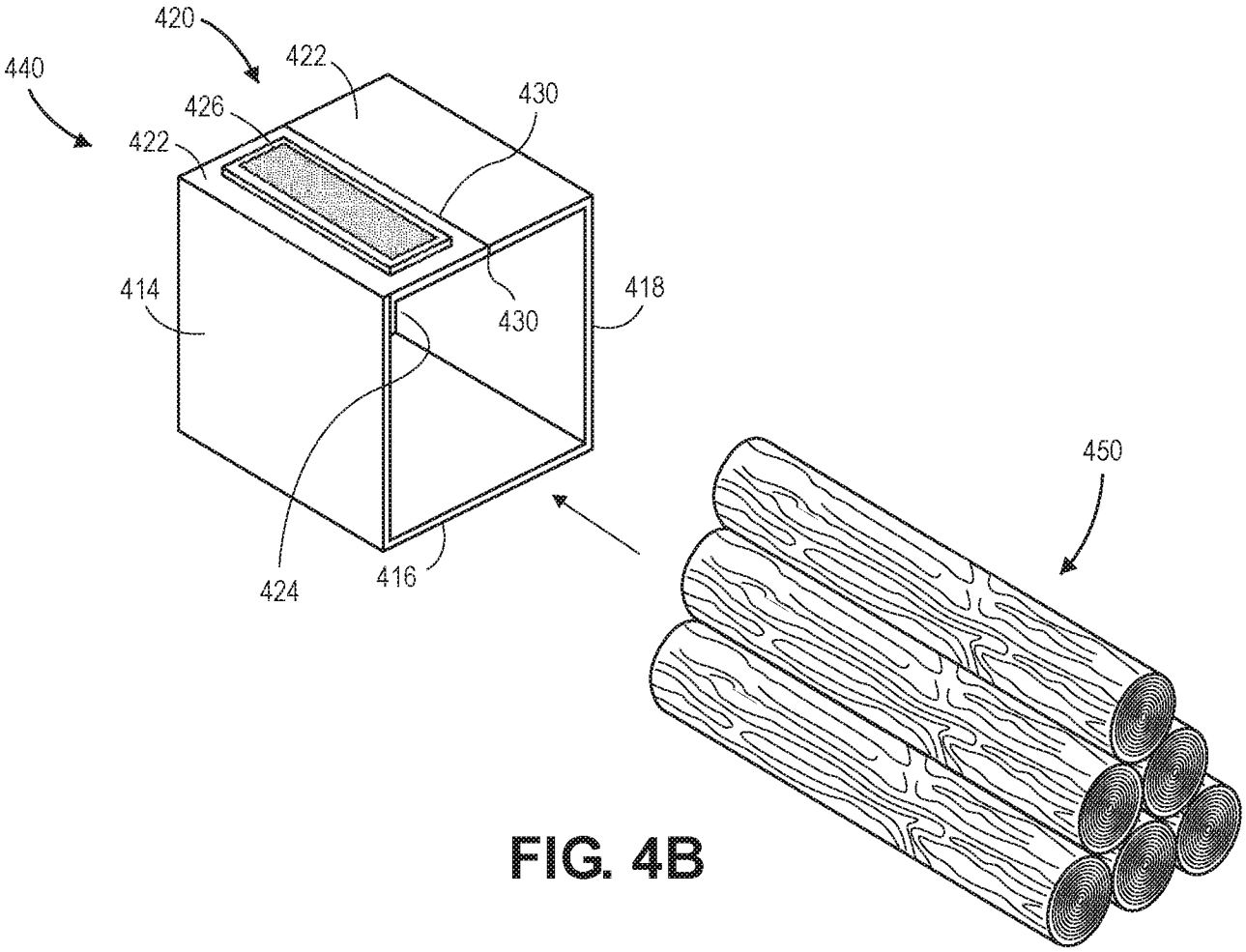
Figure 4C:
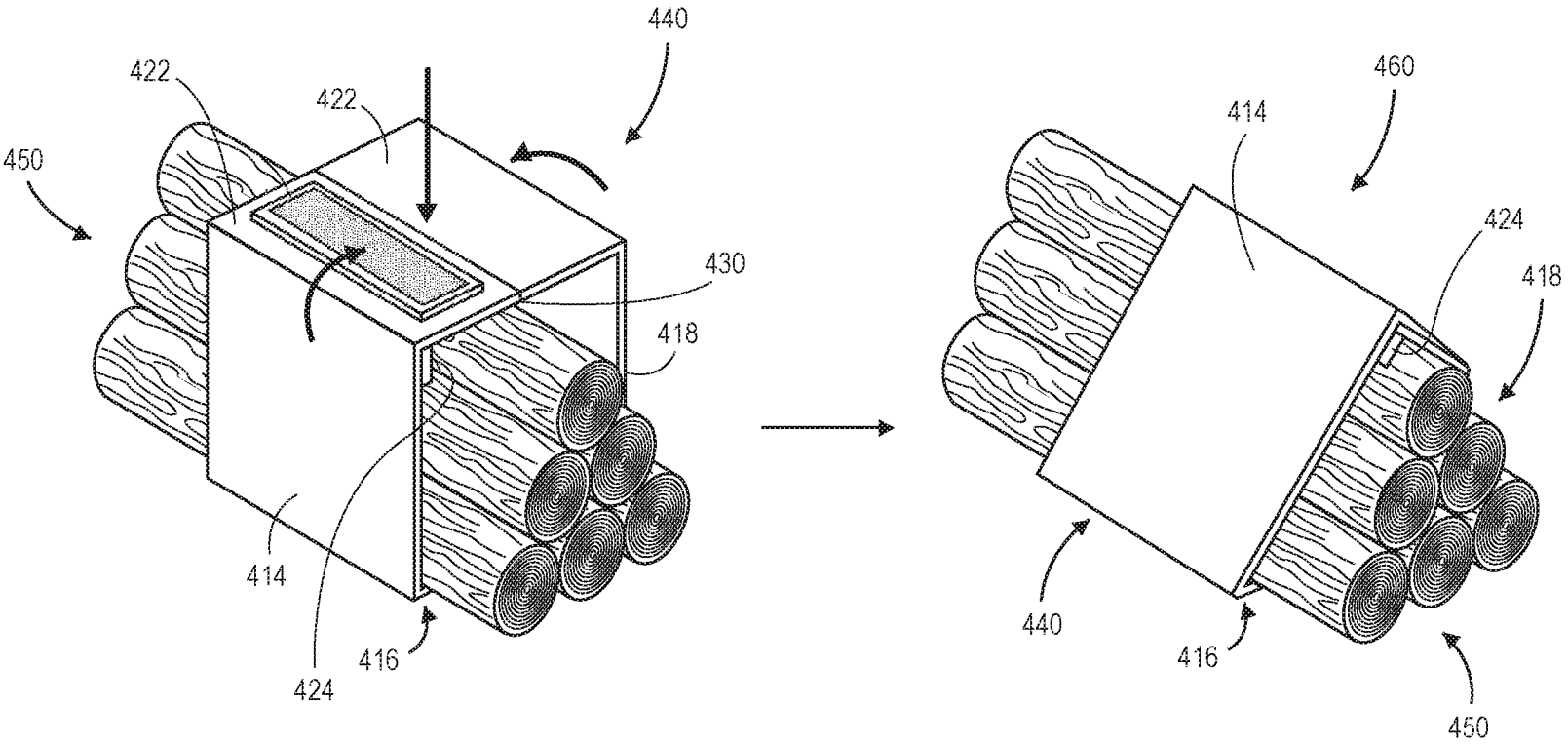
Figure 4D:
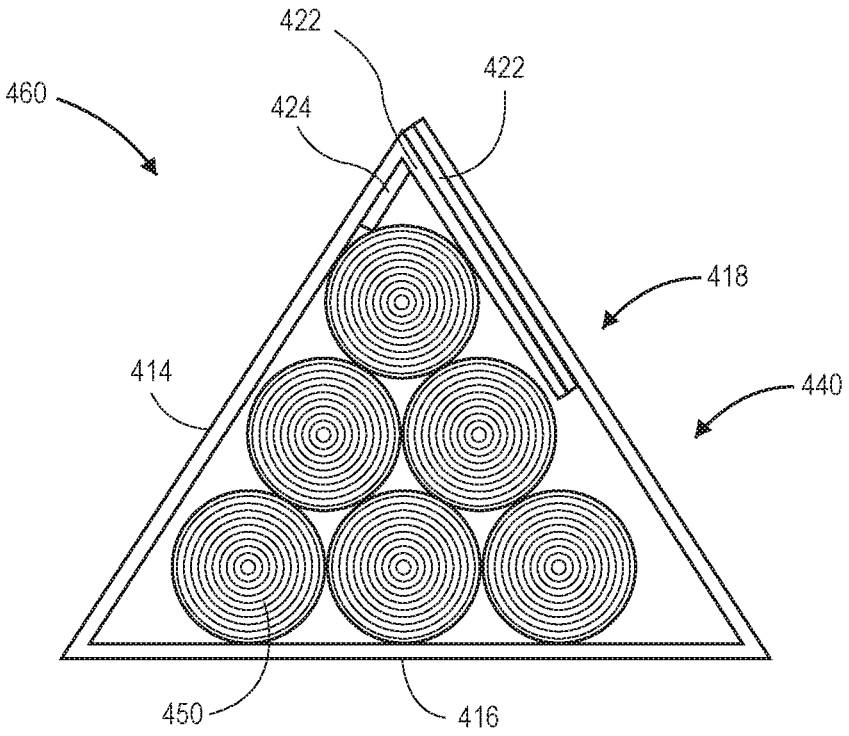

As is shown in FIG. 4B, one or more consumer goods 450 (e.g., firewood logs) may be inserted into an opening defined by the cross-section of the adhesive sleeve 440. As is shown in FIG. 4C, a package 460 may be formed by applying a force to the slack section 420, thereby causing the slack panels 422 to come into contact with one another and be joined, e.g., by the adhesive 426. As is shown in FIG. 4D, the slack panels 422 may be folded toward the back panel 418. Alternatively, the slack panels 422 may be folded toward the front panel 414. Thus, the package 460 has a substantially triangular cross-section, and is formed by effectively clasping the adhesive sleeve 440 in tension around the consumer goods 450, e.g., by joining the slack panels 422 toward one another and reducing a length of a circumference or perimeter of the adhesive sleeve 440 around the consumer goods 450.

Although the disclosure has been described herein using exemplary techniques, components, and/or processes for implementing the systems and methods of the present disclosure, it should be understood by those skilled in the art that other techniques, components, and/or processes or other combinations and sequences of the techniques, components, and/or processes described herein may be used or performed that achieve the same function(s) and/or result(s) described herein and which are included within the scope of the present disclosure. For example, although some of the implementations of adhesive sleeves of the present disclosure are described herein in connection with the enclosure of food products within containers therein, those of ordinary skill in the pertinent arts will recognize that the present disclosure is not so limited, and that the adhesive sleeves may be provided in connection with the transportation and use of commercial goods of any kind, regardless of whether such goods are maintained in containers. Moreover, the adhesive sleeves of the present disclosure may be used in any type or form of facility, and are not limited in their application or implementation to facilities where foods are prepared and packaged.

Those of ordinary skill in the pertinent arts will further recognize that the adhesive sleeves of the present disclosure may be made from any suitable materials. For example, although some of the implementations of adhesive sleeves disclosed herein are referenced as being made from blanks of paperboard, those of ordinary skill in the pertinent arts will recognize that the present disclosure is not so limited. The adhesive sleeves may be formed from blanks of two-sided sheets of one or more natural or synthetic fibers such as paper, plastic or fabric fibers, and bands formed from one or more rigid paper products including cardboards such as card stock, paperboard or corrugated fiberboard. Moreover, the adhesive sleeves may be covered on one or both sides with oil and grease resistant coatings, or with other layers of paper, plastic or fabric, or with layers of metal foils (e.g., aluminum). Additionally, although some of the implementations are shown as having adhesive sleeves that are substantially rectangular, the blanks and adhesive sleeves formed therefrom may have any shape or length in accordance with the present disclosure. In some implementations, one or more of the sheets and/or bands may include corners that are pointed, beveled, tapered or rounded, or have any other configuration or shape.

It should be understood that, unless otherwise explicitly or implicitly indicated herein, any of the features, characteristics, alternatives or modifications described regarding a particular implementation herein may also be applied, used, or incorporated with any other implementation described herein, and that the drawings and detailed description of the present disclosure are intended to cover all modifications, equivalents and alternatives to the various implementations as defined by the appended claims. Moreover, with respect to the one or more methods or processes of the present disclosure described herein, orders in which such methods or processes are presented are not intended to be construed as any limitation on the claimed inventions, and any number of the method or process steps or boxes described herein can be combined in any order and/or in parallel to implement the methods or processes described herein. Also, the drawings herein are not drawn to scale.

Conditional language, such as, among others, "can," "could," "might," or "may," unless specifically stated otherwise, or otherwise understood within the context as used, is generally intended to convey in a permissive manner that certain implementations could include, or have the potential to include, but do not mandate or require, certain features, elements and/or steps. In a similar manner, terms such as "include," "including" and "includes are generally intended to mean "including, but not limited to." Thus, such conditional language is not generally intended to imply that features, elements and/or steps are in any way required for one or more implementations or that one or more implementations necessarily include logic for deciding, with or without user input or prompting, whether these features, elements and/or steps are included or are to be performed in any particular implementation.

Disjunctive language such as the phrase "at least one of X, Y, or Z," or "at least one of X, Y and Z," unless specifically stated otherwise, is otherwise understood with the context as used in general to present that an item, term, etc., may be either X, Y, or Z, or any combination thereof (e.g., X, Y, and/or Z). Thus, such disjunctive language is not generally intended to, and should not, imply that certain implementations require at least one of X, at least one of Y, or at least one of Z to each be present.

Unless otherwise explicitly stated, articles such as "a" or "an" should generally be interpreted to include one or more described items. Accordingly, phrases such as "a device configured to" are intended to include one or more recited devices. Such one or more recited devices can also be collectively configured to carry out the stated recitations. For example, "a processor configured to carry out recitations A, B and C" can include a first processor configured to carry out recitation A working in conjunction with a second processor configured to carry out recitations B and C.

Language of degree used herein, such as the terms "about," "approximately," "generally," "nearly" or "substantially" as used herein, represent a value, amount, or characteristic close to the stated value, amount, or characteristic that still performs a desired function or achieves a desired result. For example, the terms "about," "approximately," "generally," "nearly" or "substantially" may refer to an amount that is within less than 10% of, within less than 5% of, within less than 1% of, within less than 0.1% of, and within less than 0.01% of the stated amount.

What is claimed is:

1. A package of at least one prepared food product, the package comprising:

a container, wherein the at least one prepared food product is releasably maintained within the container; and an adhesive sleeve clasping the container in tension, wherein the adhesive sleeve is formed from a blank comprising a top panel, a front panel, a bottom panel, a back panel, a first slack panel, a second slack panel, and a tab panel in series, wherein a top face of the tab panel is joined to a bottom face of the top panel by a glue to form a continuous loop, wherein the container rests on the bottom panel, wherein the front panel is aligned substantially perpendicularly with respect to at least one of the top panel or the bottom panel, wherein the back panel is aligned substantially perpendicularly with respect to at least one of the top panel or the bottom panel, and wherein a top face of the first slack panel is joined to a top face of the second slack panel by a double-sided tape.

2. The package of claim 1, wherein at least one of a top face of the top panel, the front panel or the back panel includes a visible marking thereon, and wherein the visible marking comprises at least one of:

a bar code representing a link to information regarding the at least one prepared food product;

an identifier of the at least one prepared food product;

an identifier of a component of the at least one prepared food product;

an image of the at least one prepared food product;

an instruction for preparing the at least one prepared food product for consumption;

a serving size associated with the at least one prepared food product; or a set of nutrition facts associated with the at least one prepared food product.

3. The package of claim 1, wherein the blank is formed from a first paperboard, and wherein the container is formed from at least one of:

the first paperboard;

a second paperboard;

a polyethylene; or a polystyrene.

4. A sleeve comprising:

a blank, wherein the blank comprises:

a plurality of body panels;

a slack section comprising a first slack panel and a second slack panel;

a first adhesive applied to a front face of the first slack panel;

a tab panel; and a second adhesive applied to a front face of the tab panel, wherein the front face of the tab panel is joined to a rear face of a first one of the plurality of body panels by the second adhesive to form a continuous loop, wherein each of the plurality of body panels, the first slack panel and the second slack panel have a common width, wherein each of the plurality of body panels, the first slack panel, the second slack panel and the tab panel are arranged in series, wherein the slack section is provided in series between a second one of the plurality of body panels and the tab panel, and wherein the blank is configured for folding about at least one line between two panels selected from the group consisting of:

the plurality of body panels;

the first slack panel;

the second slack panel; and the tab panel.

5. The sleeve of claim 4, wherein the blank is folded about a first line between the first slack panel and the second slack panel, and wherein the blank is folded about a second line between two of the plurality of body panels.

6. The sleeve of claim 4, wherein the sleeve is wrapped around at least one item within the continuous loop.

7. The sleeve of claim 6, wherein the at least one item is a container of at least one food product.

8. The sleeve of claim 4, wherein the common width is approximately six-and-one-half inches, and wherein each of the plurality of body panels has a length between approximately five inches and approximately six inches.

9. The sleeve of claim 4, wherein the first adhesive is a double-sided adhesive tape, and wherein the second adhesive is one of a double-sided adhesive tape or a glue.

10. A sleeve comprising:

a blank, wherein the blank comprises:

a plurality of body panels, wherein the plurality of body panels comprises:

a top panel;

a front panel;

a bottom panel; and a back panel, a slack section comprising a first slack panel and a second slack panel;

a first adhesive applied to a front face of the first slack panel;

a tab panel; and a second adhesive applied to a front face of the tab panel, wherein the front face of the tab panel is joined to a rear face of the top panel by the second adhesive to form a continuous loop, wherein each of the plurality of body panels, the first slack panel and the second slack panel have a common width, wherein each of the plurality of body panels, the first slack panel, the second slack panel and the tab panel are arranged in series, wherein a first edge of the top panel is joined to a first edge of the front panel along a first line, wherein a second edge of the front panel is joined to a first edge of the bottom panel along a second line, wherein a second edge of the bottom panel is joined to a first edge of the back panel along a third line, wherein a second edge of the back panel is joined to a first edge of the first slack panel along a fourth line, wherein a second edge of the first slack panel is joined to a first edge of the second slack panel along a fifth line, wherein a second edge of the second slack panel is joined to a first edge of the tab panel along a sixth line, and wherein the blank is folded about at least one of the first line, the second line, the third line, the fourth line, the fifth line or the sixth line to form the continuous loop.

11. The sleeve of claim 10, wherein the top panel further comprises a tear strip releasably formed between a third edge of the top panel and a fourth edge of the top panel, and wherein the continuous loop is opened when the tear strip is removed from the top panel.

12. The sleeve of claim 10, wherein at least one marking comprising at least one of a word, a symbol, a character or an image is provided on at least one of:

a front face of the front panel;

a front face of the back panel; or a front face of the top panel.

13. The sleeve of claim 12, wherein the at least one marking is one of:

a bar code representing a link to information regarding at least one item;

an identifier of the at least one item;

an identifier of a component of the at least one item;

an image of the at least one item;

an instruction for preparing the at least one item for use;

a serving size associated with the at least one item; and a set of nutrition facts associated with the at least one item.

14. The sleeve of claim 10, wherein each of the first line, the second line, the third line, the fourth line and the fifth line and the sixth line comprises at least one of:

a crease;

a groove;

a perforation;
a ridge; or
a score.

15. A sleeve comprising:
a blank, wherein the blank is formed from at least one of a solid bleached board paperboard or a solid bleached sulfate paperboard, and wherein the blank comprises:
a plurality of body panels;
a slack section comprising a first slack panel and a second slack panel;
a first adhesive applied to a front face of the first slack panel;
a tab panel; and
a second adhesive applied to a front face of the tab panel,
wherein the front face of the tab panel is joined to a rear face of a first one of the plurality of body panels by the second adhesive to form a continuous loop,
wherein each of the plurality of body panels, the first slack panel and the second slack panel have a common width,
wherein each of the plurality of body panels, the first slack panel, the second slack panel and the tab panel are arranged in series,
wherein the blank is configured for folding about at least one line between two panels selected from the group consisting of:
the plurality of body panels;
the first slack panel;
the second slack panel; and
the tab panel.

16. The sleeve of claim 15, wherein the slack section is provided in series between two of the plurality of body panels.

17. The sleeve of claim 15, wherein the sleeve is wrapped around a container of at least one food product within the continuous loop,
wherein the common width is approximately six-and-one-half inches, and
wherein each of the plurality of body panels has a length between approximately five inches and approximately six inches.

18. A sleeve comprising:
a blank, wherein the blank comprises:
a plurality of body panels, wherein the plurality of body panels comprises:
a front panel;
a bottom panel; and
a back panel;
a slack section comprising a first slack panel and a second slack panel;
a first adhesive applied to a front face of the first slack panel;
a tab panel; and
a second adhesive applied to a front face of the tab panel,
wherein the front face of the tab panel is joined to a rear face of the front panel by the second adhesive to form a continuous loop,
wherein each of the plurality of body panels, the first slack panel and the second slack panel have a common width,
wherein each of the plurality of body panels, the first slack panel, the second slack panel and the tab panel are arranged in series,
wherein a first edge of the front panel is joined to a first edge of the bottom panel along a first line,
wherein a second edge of the bottom panel is joined to a first edge of the back panel along a second line,
wherein a second edge of the back panel is joined to a first edge of the first slack panel along a third line,
wherein a second edge of the first slack panel is joined to a first edge of the second slack panel along a fourth line,
wherein a second edge of the second slack panel is joined to a first edge of the tab panel along a fifth line, and
wherein the sleeve is folded about at least one of the first line, the second line, the third line, the fourth line or the fifth line to form the continuous loop.

19. A method for preparing a container comprising:
opening a sleeve from a flattened state to an expanded state,
wherein the sleeve is formed from a blank comprising a top panel, a front panel, a bottom panel, a back panel, a first slack panel, a second slack panel, a first adhesive applied to a front face of the first slack panel, a tab panel, and a second adhesive applied to a front face of the tab panel,
wherein a first edge of the top panel is joined to a first edge of the front panel along the first line,
wherein a second edge of the front panel is joined to a first edge of the bottom panel along a second line,
wherein a second edge of the bottom panel is joined to a first edge of the back panel along a third line,
wherein a second edge of the back panel is joined to a first edge of the first slack panel along a fourth line,
wherein a second edge of the first slack panel is joined to a first edge of the second slack panel along a fifth line,
wherein a second edge of the second slack panel is joined to a first edge of the tab panel along a sixth line,
wherein the front face of the tab panel is joined to a rear face of the top panel by the second adhesive, and
wherein the sleeve defines an opening having a substantially constant cross-section in the expanded state;
inserting the container into the opening;
folding the first slack panel and the second slack panel about the fifth line; and
joining the front face of the first slack panel with a front face of the second slack panel by the first adhesive.

20. The method of claim 19, wherein each of the first line, the second line, the third line, the fourth line, the fifth line and the sixth line comprises at least one of a crease, a groove, a perforation, a ridge, or a score,
wherein the first adhesive is a double-sided adhesive tape, and
wherein the second adhesive is one of a double-sided adhesive tape or a glue.

* * * * *